US010781667B2

(12) United States Patent
Berry et al.

(10) Patent No.: US 10,781,667 B2
(45) Date of Patent: Sep. 22, 2020

(54) DRILLER'S CONTROL STATION

(71) Applicant: SCHLUMBERGER TECHNOLOGY CORPORATION, Sugar Land, TX (US)

(72) Inventors: Joe Rodney Berry, Cypress, TX (US); Robert Metz, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 102 days.

(21) Appl. No.: 16/097,459

(22) PCT Filed: May 1, 2017

(86) PCT No.: PCT/US2017/030331

§ 371 (c)(1),
(2) Date: Oct. 29, 2018

(87) PCT Pub. No.: WO2017/190122

PCT Pub. Date: Nov. 2, 2017

(65) Prior Publication Data

US 2019/0145224 A1 May 16, 2019

Related U.S. Application Data

(60) Provisional application No. 62/329,685, filed on Apr. 29, 2016.

(51) Int. Cl.
*E21B 41/00* (2006.01)
*E21B 15/00* (2006.01)

(52) U.S. Cl.
CPC ..... *E21B 41/00* (2013.01); *E21B 15/00* (2013.01)

(58) Field of Classification Search
CPC ..... E21B 15/00
USPC ..... 175/219
See application file for complete search history.

(56) References Cited

U.S. PATENT DOCUMENTS 6,629,572 B2 * 10/2003 Womer ..... E21B 44/00 175/219
2002/0060093 A1 5/2002 Womer et al.
2012/0217006 A1 8/2012 Springett et al.
2014/0102799 A1 4/2014 Stringer et al.
2014/0151120 A1 6/2014 Ledbetter et al.

FOREIGN PATENT DOCUMENTS

KR 10-2013-0125251 A 11/2013
RU 21933 U1 2/2002

* cited by examiner

*Primary Examiner* — Robert E Fuller
*Assistant Examiner* — Lamia Quaim
(74) *Attorney, Agent, or Firm* — Rachel Greene

(57) ABSTRACT

A workstation system for monitoring and controlling subsystems on a drilling rig, the system comprising: first and second workstation alcoves positioned near a drill rig floor so as to provide operators with direct lines of sight while sitting or standing in the alcoves to control drill rig subsystems, wherein each of the first and second workstation alcoves comprise: an operator chair; a plurality of controls for controlling the at least one first drill rig subsystem; at least one display of a graphical representation of the at least one first drill rig subsystem.

20 Claims, 30 Drawing Sheets

DRILLER'S CONTROL STATION

PRIORITY STATEMENT

This application claims priority to U.S. Provisional Application No. 62/329,685, filed 29 Apr. 2016.

TECHNICAL FIELD

The present disclosure relates to a system and process for controlling drilling rig subsystems with two work station alcoves positioned near a drill rig floor to provide direct lines of sight to the subsystems being controlled.

BACKGROUND ART

Drilling systems for drilling wells in the earth, such as drill rigs, typically have controls that allow a driller or operator to manage and control various drilling subsystems during drilling operations.

U.S. Pat. No. 6,629,572 illustrates a prior art operator workstation for use on a drilling rig including integrated control and information. The drilling rig system includes a man-machine workstation interface located in proximity to the drilling rig for providing to a single operator at substantially one location simultaneous operational access to drilling rig processes. The workstation includes an adjustable base and an operator alcove formed on the base in which an operator is positioned allowing for a substantially unobstructed view of the drilling rig. Adjustable forearm support panels are formed on opposing sides of the operator alcove for supporting the forearms of the operator while positioned in the alcove. At least one display unit is adjustably connected to the base and has a touch access screen adapted to allow the operator to monitor and control drilling rig processes. A plurality of discrete hand controls are used for controlling predetermined drilling rig processes wherein at least one of the discrete hand controls is located on the forearm support panels. Preferably, an operator chair is positioned in the alcove and is slideably connected to the base permitting seating and standing operation of the workstation. Data from multiple associated drilling equipment is integrated with data from a current drilling rig process to provide data to the operator on a process oriented basis displayed on said display units.

SUMMARY OF INVENTION

In accordance with the teachings of the present disclosure, disadvantages and problems associated with existing drill rig control systems are alleviated.

According to one aspect of the invention, there is provided a workstation system for monitoring and controlling subsystems on a drilling rig, the system comprising: a first workstation alcove positioned near a drill rig floor so as to provide an operator with direct lines of sight while sitting or standing in the alcove to at least one first drill rig subsystem being controlled by the first workstation, the first workstation alcove comprising: an operator chair; a plurality of controls for controlling the at least one first drill rig subsystem; at least one display of a graphical representation of the at least one first drill rig subsystem; and a second workstation alcove positioned near a drill rig floor so as to provide an operator with direct lines of sight while sitting or standing in the alcove to at least one second drill rig subsystem being controlled by the second workstation, the second workstation alcove comprising: an operator chair; a plurality of controls for controlling the at least one second drill rig subsystem; at least one display of a graphical representation of the at least one second drill rig subsystem.

A further aspect of the invention provides a process for monitoring and controlling subsystems on a drilling rig, the process comprising: positioning a first workstation alcove near a drill rig floor so as to provide an operator with direct lines of sight while sitting or standing in the alcove to at least one first drill rig subsystem; controlling the at least one first drill rig subsystem by the first workstation; positioning a second workstation alcove near a drill rig floor so as to provide an operator with direct lines of sight while sitting or standing in the alcove to at least one second drill rig subsystem; and controlling the at least one second drill rig subsystem by the second workstation.

BRIEF DESCRIPTION OF DRAWINGS

A more complete understanding of the present embodiments may be acquired by referring to the following description taken in conjunction with the accompanying drawings, in which like reference numbers indicate like features.

The objects and features of the invention will become more readily understood from the following detailed description and appended claims when read in conjunction with the accompanying drawings in which like numerals represent like elements.

Figure 1:
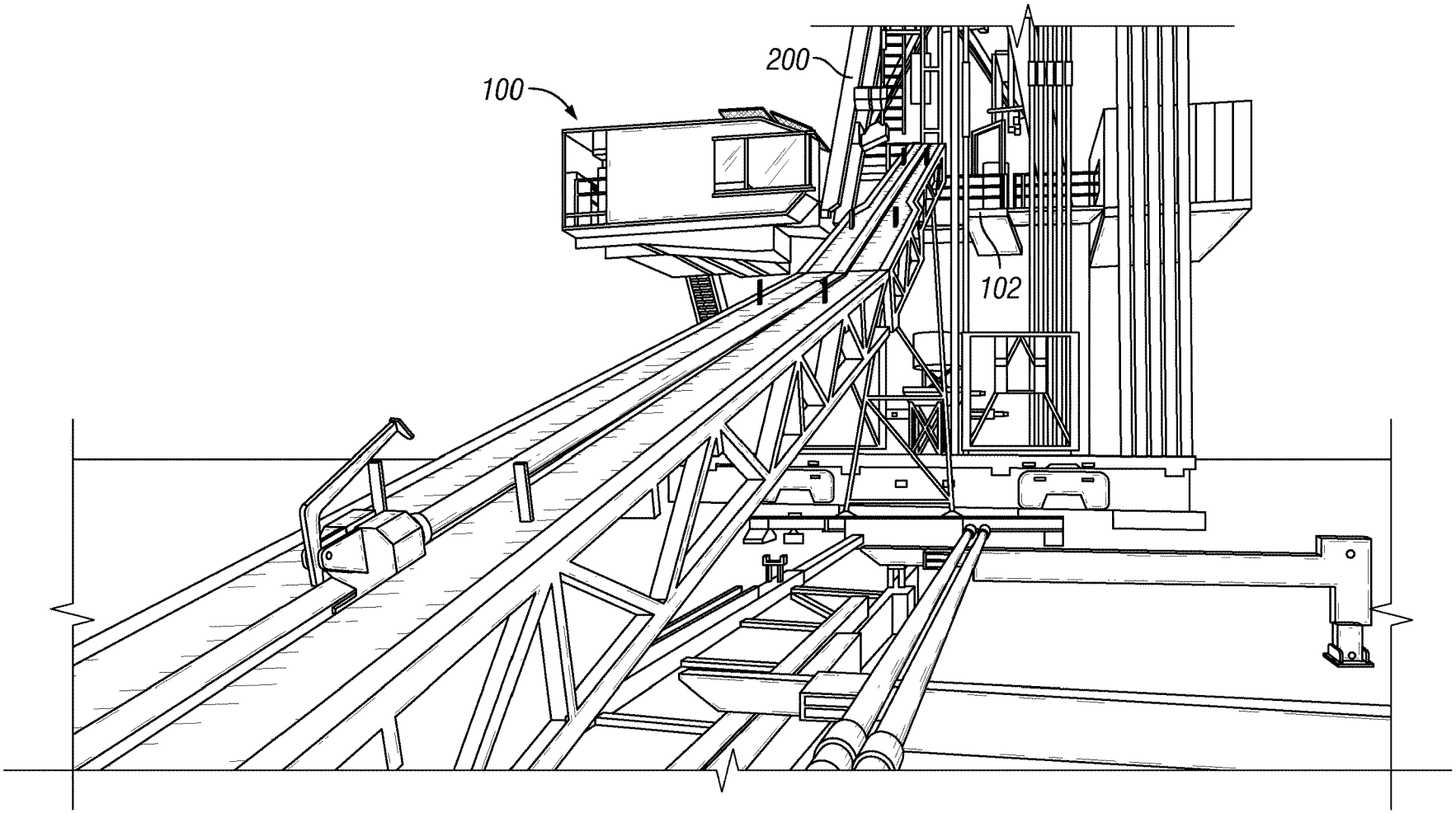
FIG. 1 is a perspective view of a drill rig with a work station enclosure positioned near a drilling floor.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DESCRIPTION OF EMBODIMENTS

Preferred embodiments are best understood by reference to FIGS. 1-19B below in view of the following general discussion. The present disclosure may be more easily understood in the context of a high level description of certain embodiments.

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range. The statements made herein merely provide information related to the present disclosure and may not constitute prior art, and may describe some embodiments illustrating the invention.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

The way an operator manipulates his control equipment to control the rig activity and activities that support the rig activity relies on his line of sight and his access to the systems that control the mechanical and electrical systems. The chair design, its orientation in a cabin, his proximity to his fellow operators, the size, location, and other parameters of the windows in the cabin, the cabin's design, and the cabin's orientation within the surrounding system are all factors that influence the operator's control. The following series of figures and workflow illustrate design elements that work together to facilitate a line of sight and control of the rig activity and rig support activity such as tripping out, tripping in, guiding, standbuilding, etc.

FIG. 1 shows an drilling rig with a driller's control station located on the driller's side of the drill rig floor.

Figure 2:
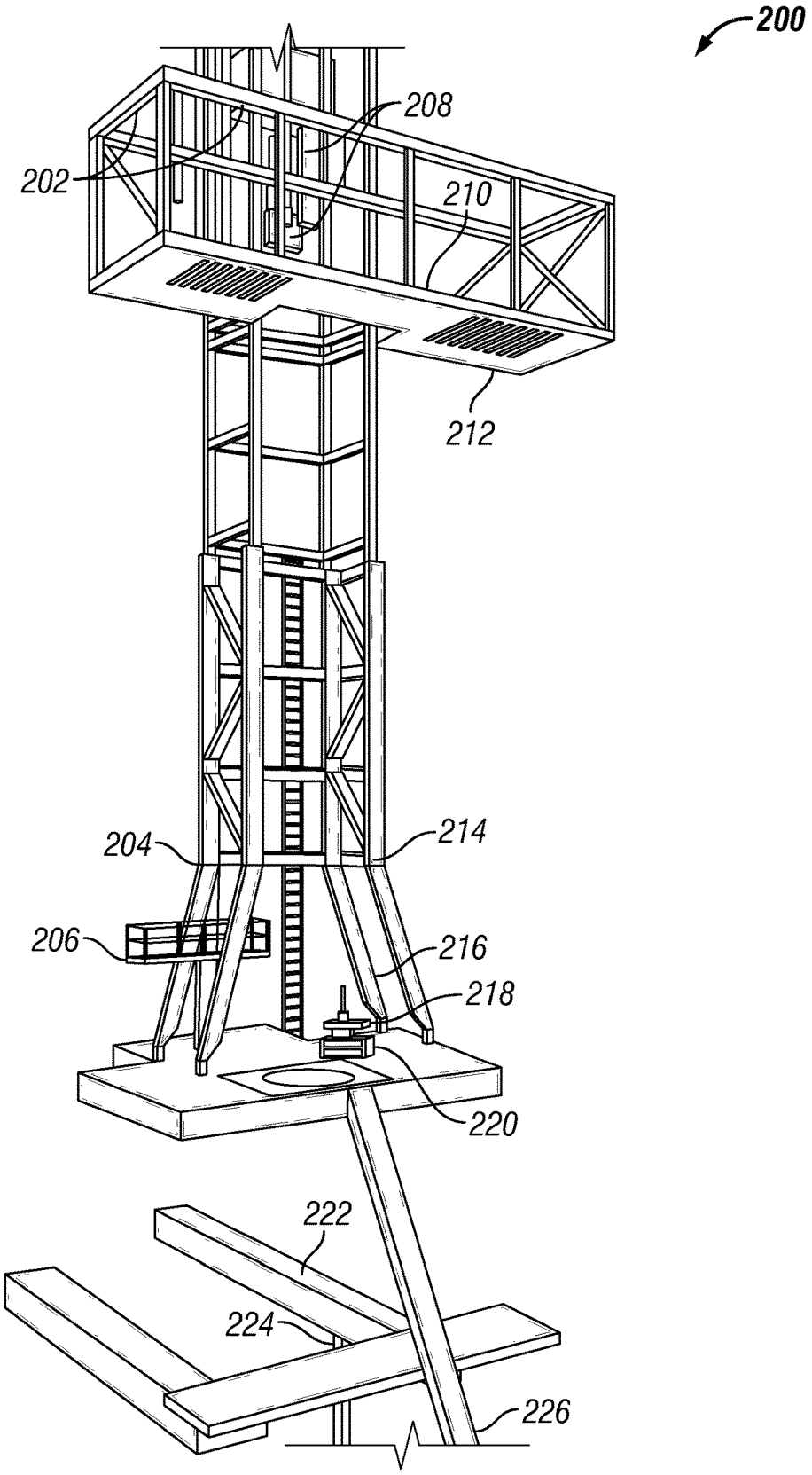
FIG. 2 is a perspective view of the drilling rig of FIG. 1, wherein subsystem components are identified.

FIG. 2 illustrates the drilling rig of FIG. 1, wherein various components are removed (hidden) for clarity. The drill rig 200 has a transfer bridge crane 202 for moving stands to a position over the wellbore. A lower stabilizing arm 204 helps to position the stands. A mudbucket 206 is available on the drill floor. A top drive 208 is positioned in the mast of the drill rig 200. A fingerboard 210 extends from the mast to secure stands in the upright position, with the aid of an upper stand constraint 212. A tubular delivery arm 214 delivers pipe. A tong handling arm 216 transports a pipe tong to-from the well center and mousehole positions. An iron roughneck 218 and a casing tong 220 are positioned at the rig floor for make-up and break-out processes. A mousehole 222 is positioned adjacent the wellbore and a stand handoff position 224. A catwalk machine 226 delivers pipe sections to the rig floor.

Figure 3A:
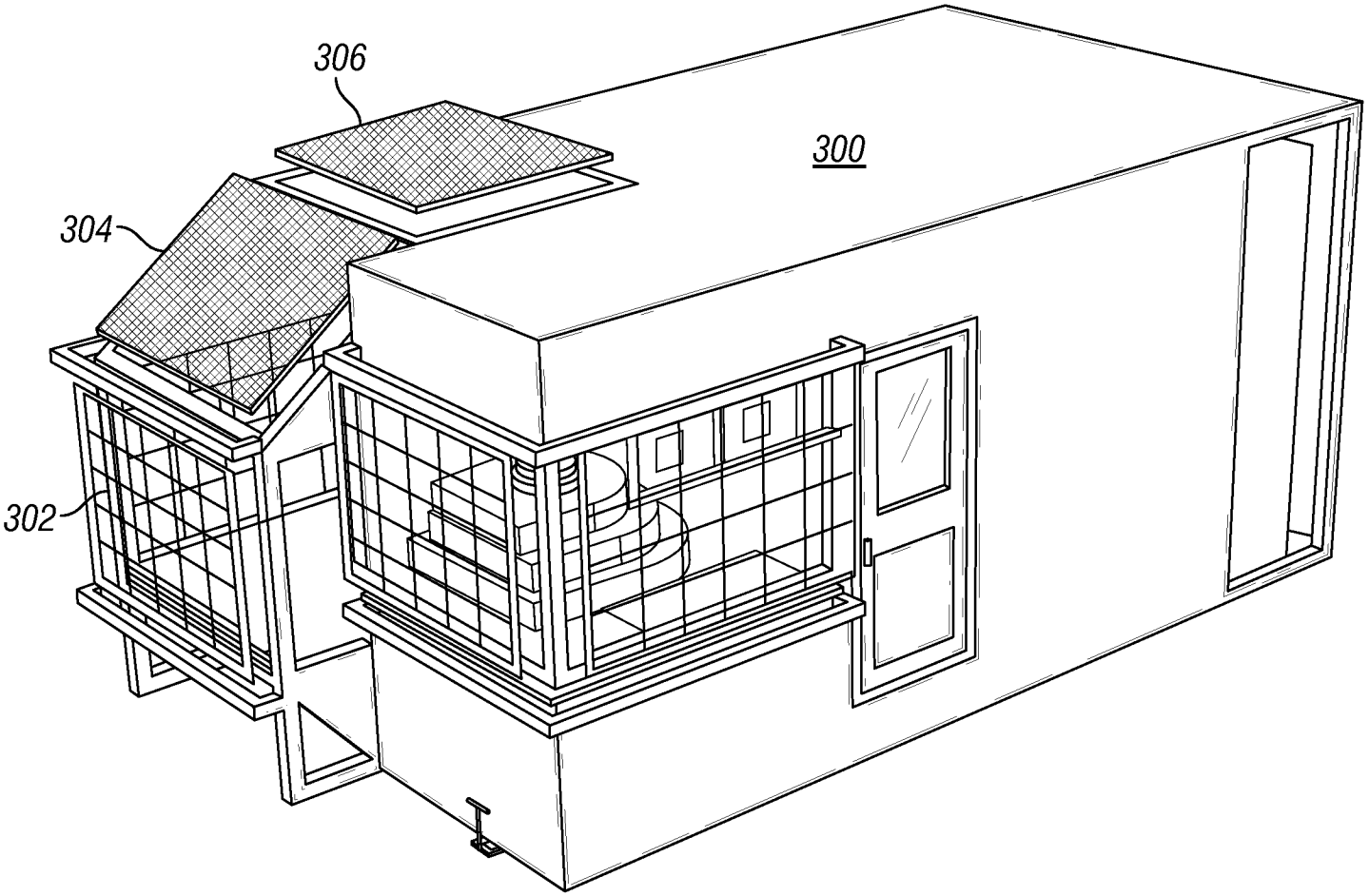
FIG. 3A shows an exterior perspective view of a work station enclosure having two work station alcoves.
Figure 3B:
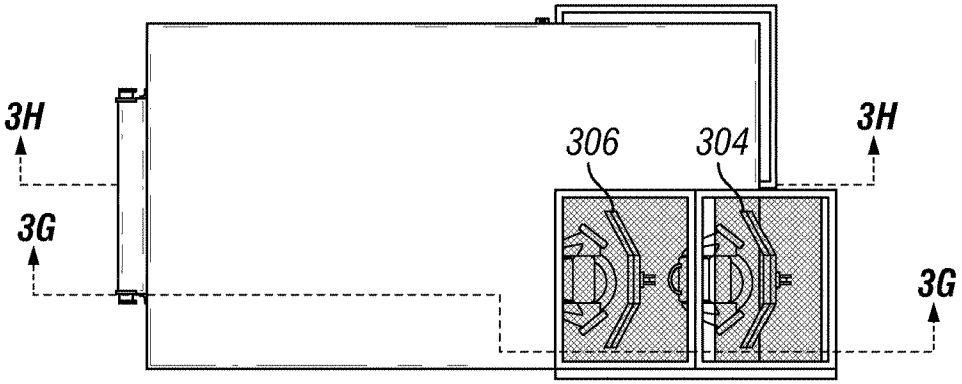
FIG. 3B is a top view of the work station enclosure of FIG. 3A.
Figure 3E:
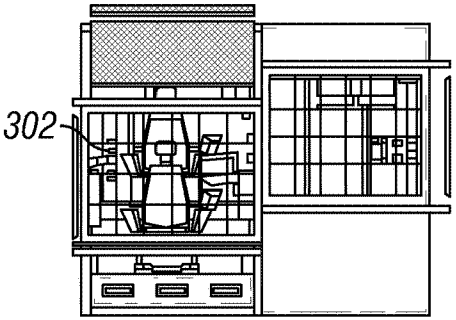
FIG. 3E is a front end view of the work station enclosure of FIG. 3A.
Figure 3D:
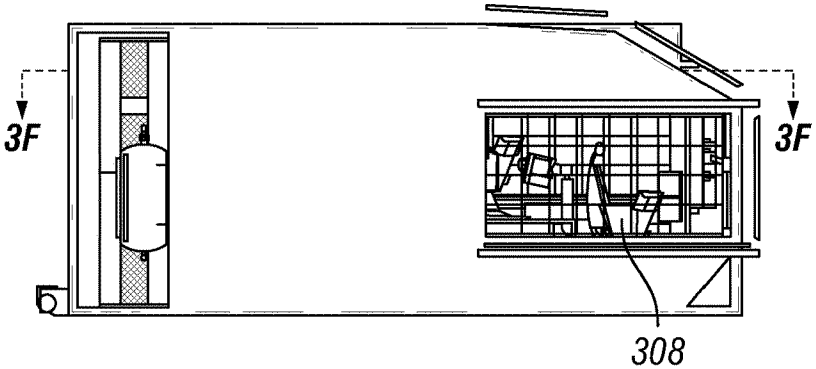
FIG. 3D is a side view of the work station enclosure of FIG. 3A.
Figure 3C:
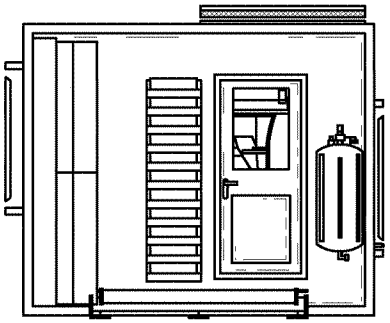
FIG. 3C is a back end view of the work station enclosure of FIG. 3A.
Figure 3F:
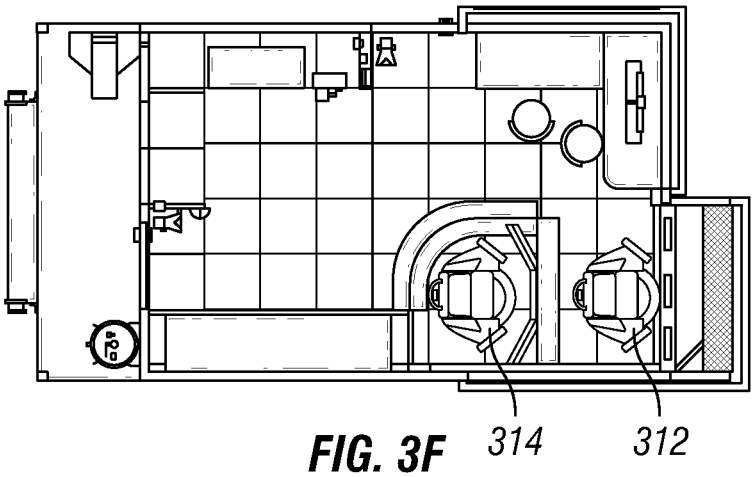
FIG. 3F is cross-sectional top view of the work station enclosure of FIG. 3D taken at Section A.
Figure 3G:
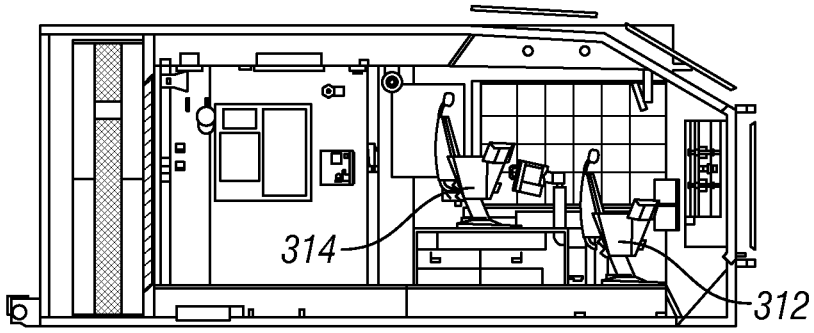
FIG. 3G is cross-sectional side view of the work station enclosure of FIG. 3B taken at Section B.
Figure 3H:
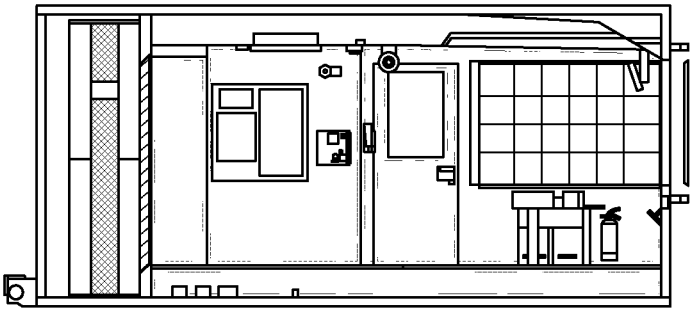
FIG. 3H is cross-sectional side view of the work station enclosure of FIG. 3B taken at Section C.
Figure 3I:
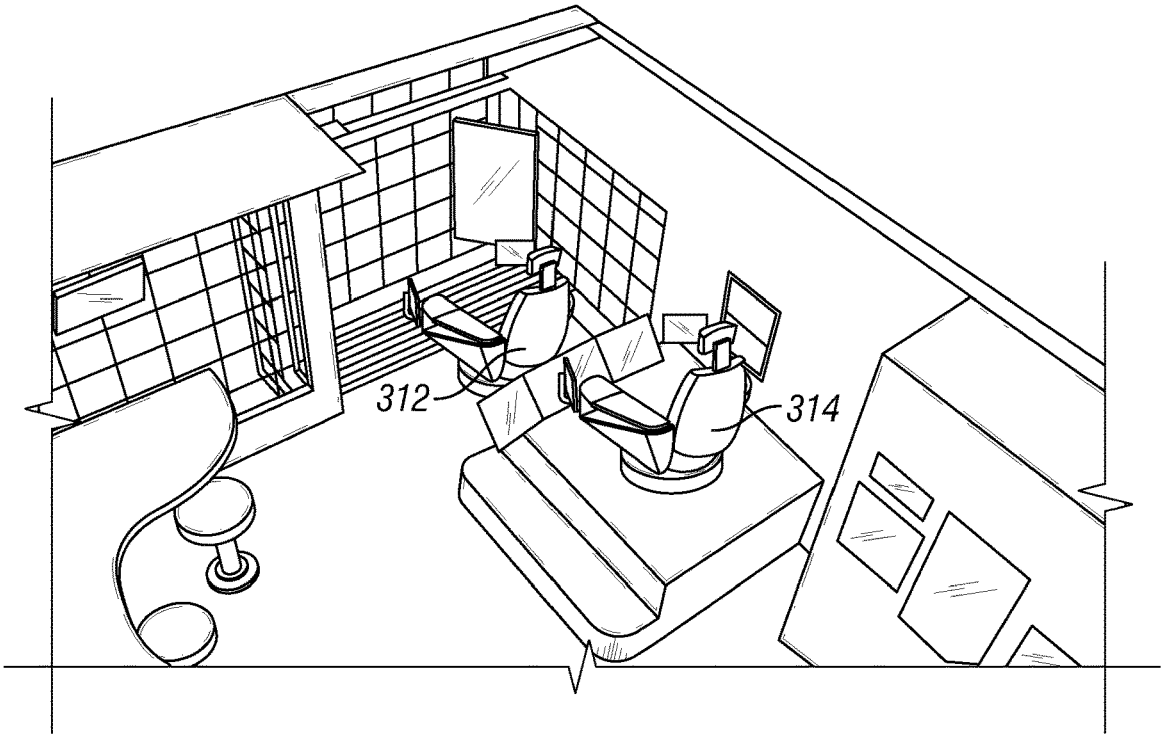
FIG. 3I is an interior perspective view of the work station enclosure of FIG. 3A wherein two work station alcoves are positioned one in front of the other.
Figure 3J:
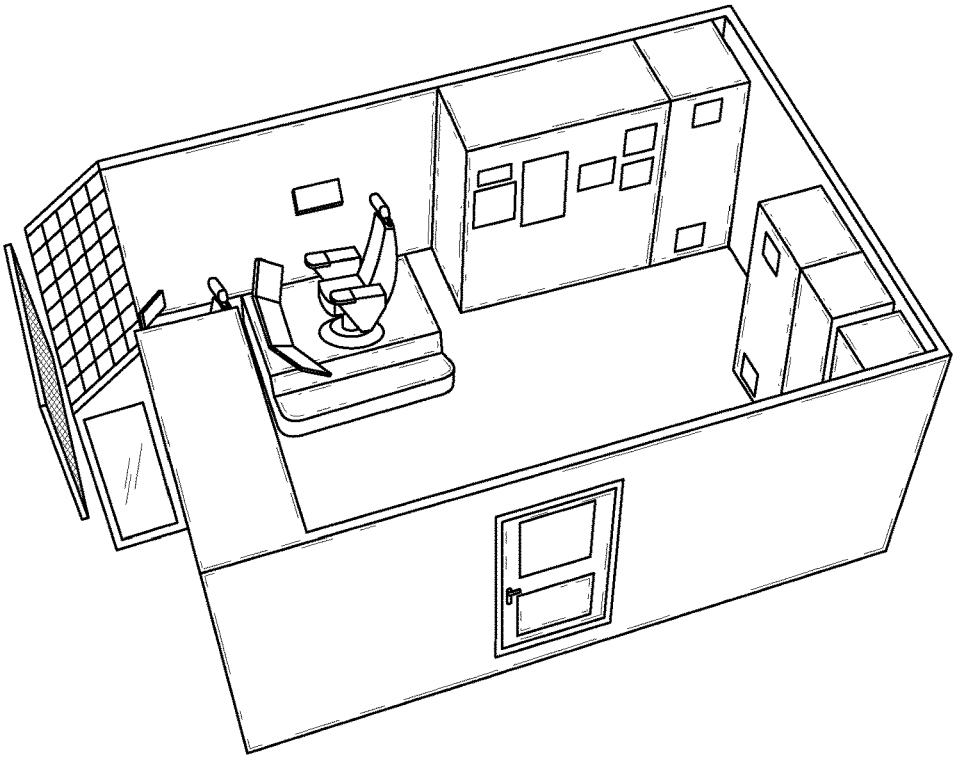
FIG. 3J is a cross-sectional interior perspective view of the work station enclosure of FIG. 3A.
Figure 3K:
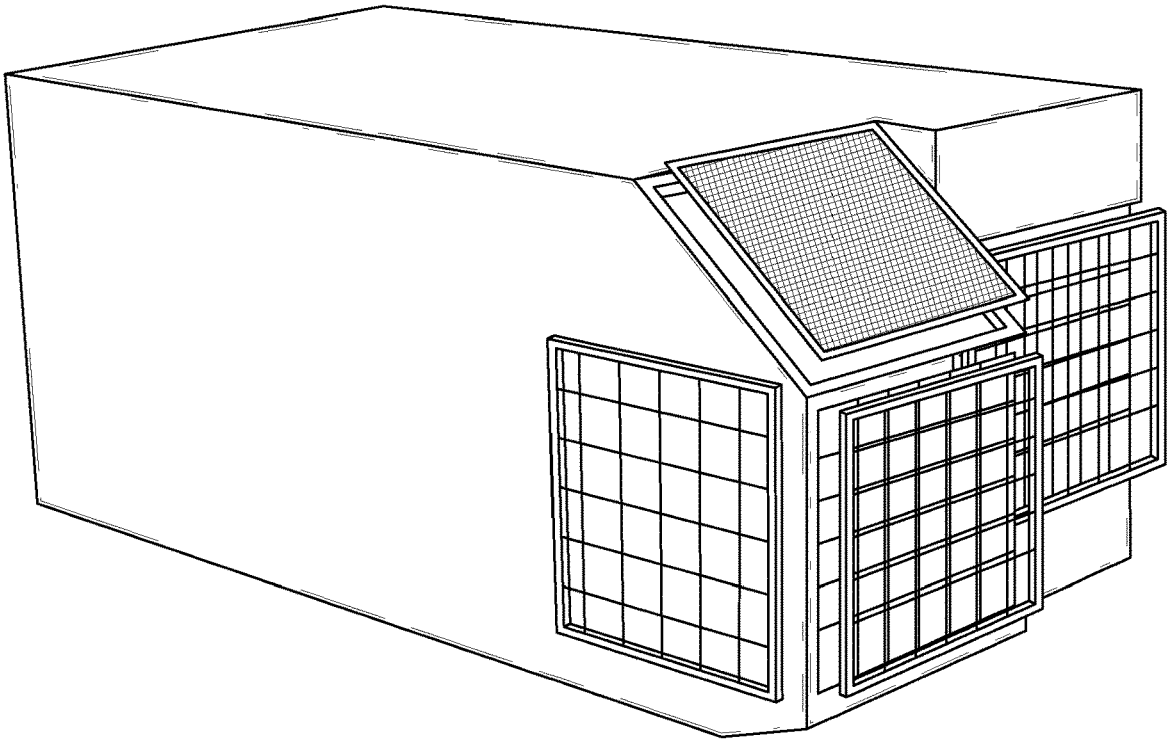
FIG. 3K is a cross-sectional exterior perspective view of the work station enclosure of FIG. 3A.

FIGS. 3A-3E show perspective, top, back, side, and front views of an embodiment of a driller's control station (rabbit cage) 300. FIG. 3F shows a cross-sectional view taken at Section A of FIG. 3D. FIG. 3G shows a cross-sectional view taken at Section B of FIG. 3B. FIG. 3G shows a cross-sectional view taken at Section C of FIG. 3B. FIG. 3I shows a perspective view of the interior of the driller's control station (rabbit cage) 300, wherein two operator alcoves are configured one behind the other like stadium seating. FIG. 3J illustrates another perspective view of the interior of the driller's control station (rabbit cage) 300. FIG. 3K shows an exterior perspective view of the driller's control station (rabbit cage) 300, wherein two operator alcoves are configured one behind the other like stadium seating.

Figure 4A:
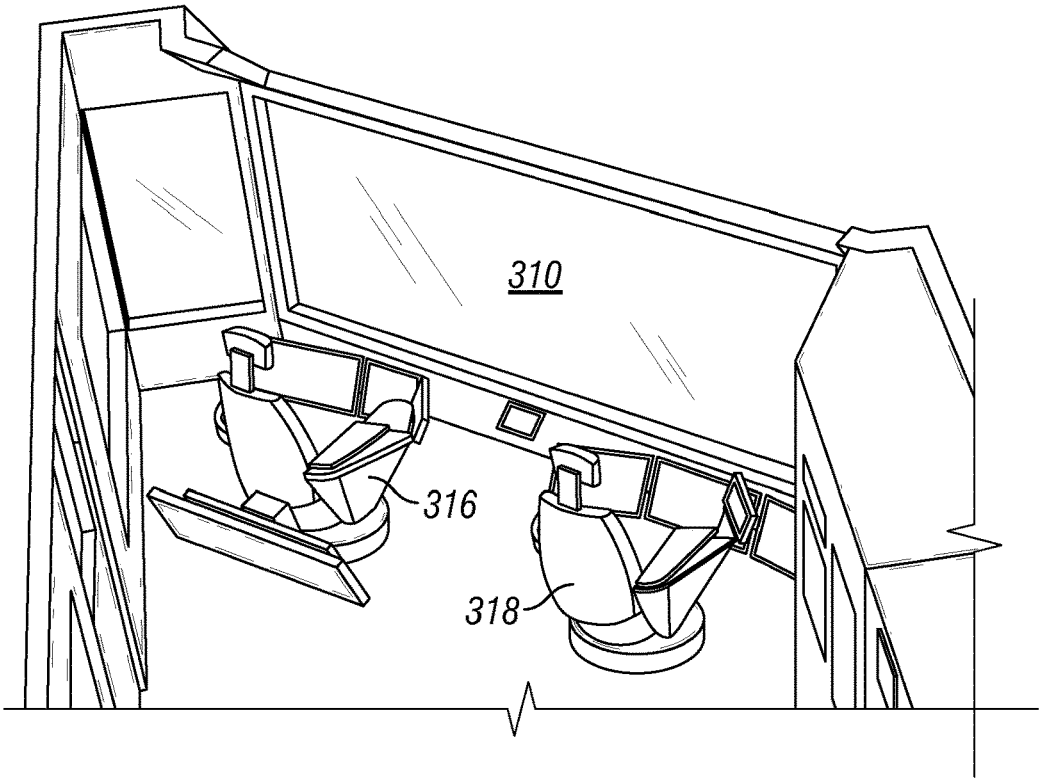
FIG. 4A is an interior perspective view of a work station enclosure wherein two work station alcoves are positioned side-by-side.
Figure 4B:
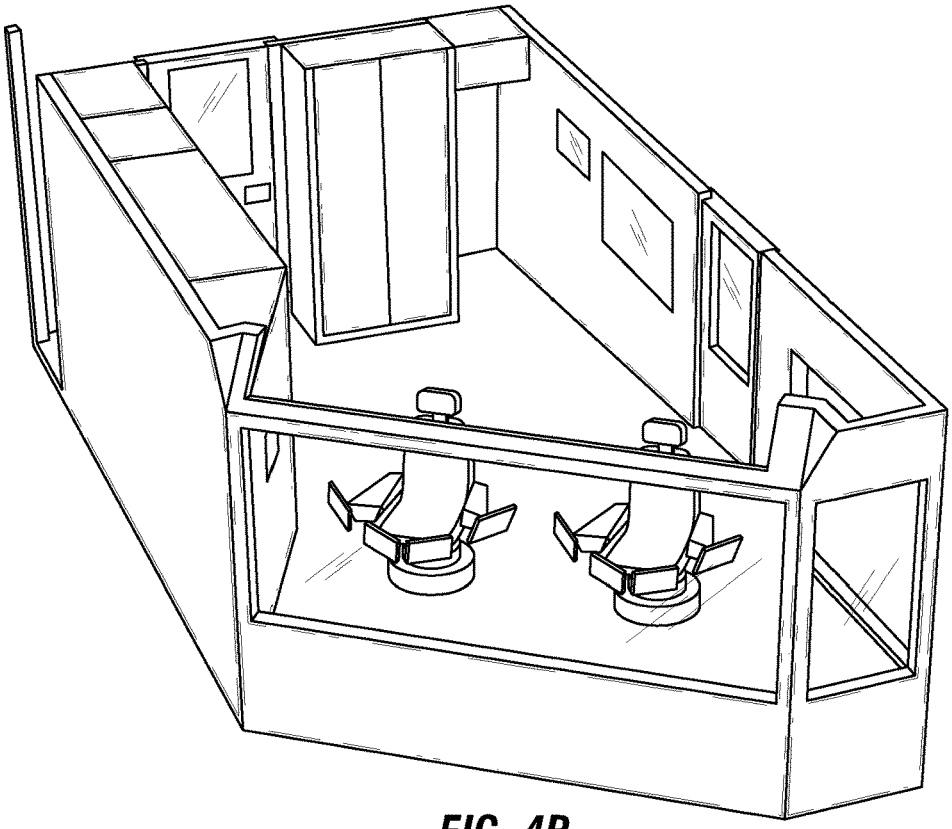
FIG. 4B is an exterior perspective view of the work station enclosure of FIG. 4A.

FIG. 4A illustrates an interior perspective view of an alternative embodiment of a driller's control station (rabbit cage) 400, wherein two operator alcoves are side-by-side and the viewing window is set at an angle (about 30 degrees) relative to the side walls of the station. FIG. 4B illustrates an exterior perspective view of the side-by-side with angled window embodiment control station (rabbit cage) 500.

Figure 5:
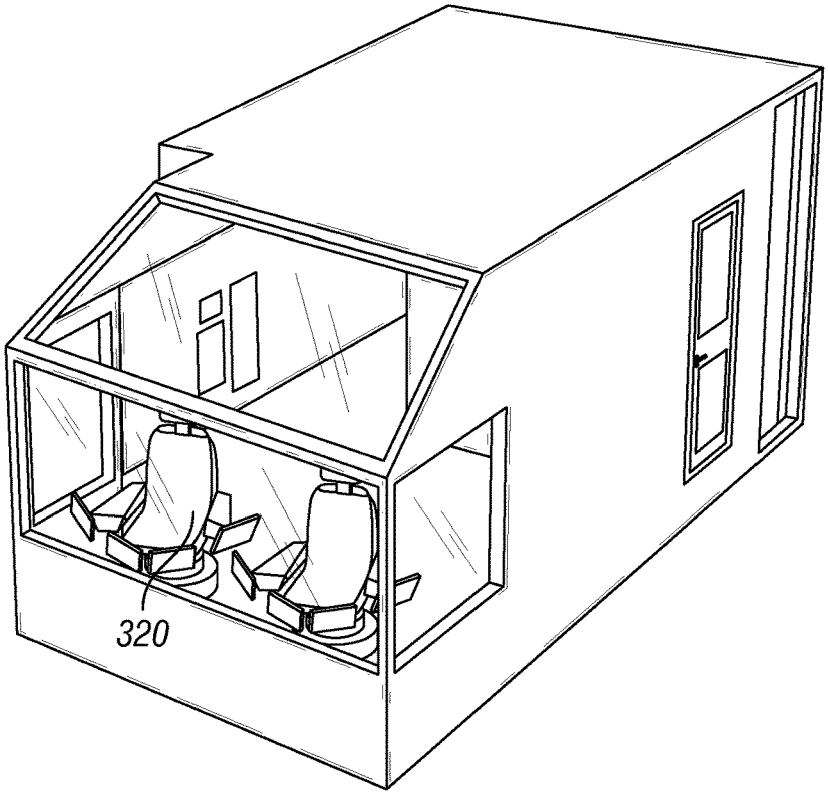
FIG. 5 is an exterior perspective view of a work station enclosure wherein two work station alcoves are positioned side-by-side.

FIG. 5 illustrates an exterior perspective view of a further alternative embodiment of a driller's control station (rabbit cage) 500, wherein the control alcoves are side-by-side and the viewing window is perpendicular to the side walls of the station.

Figure 6A:
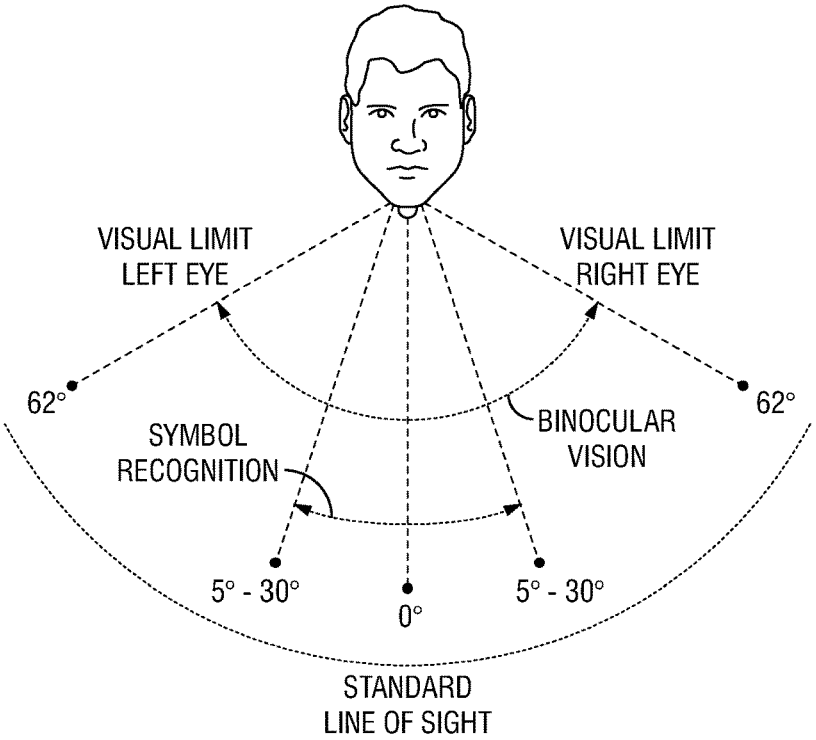
FIG. 6A shows standard horizontal line of sight visual limits for persons with binocular vision.

FIG. 6A shows a top view of standard lines of sight for persons with binocular vision.

Figure 6B:
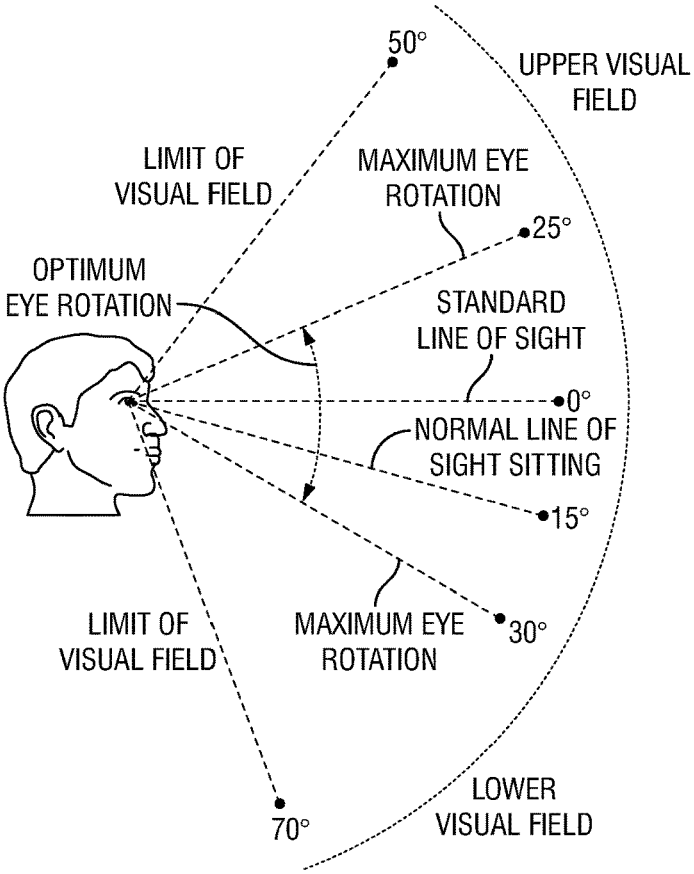
FIG. 6B shows standard vertical line of sight visual limits for persons with binocular vision.

FIG. 6B illustrates a side view of standard lines of sight for persons with optimal eye rotation and limits of visual field.

Figure 7A:
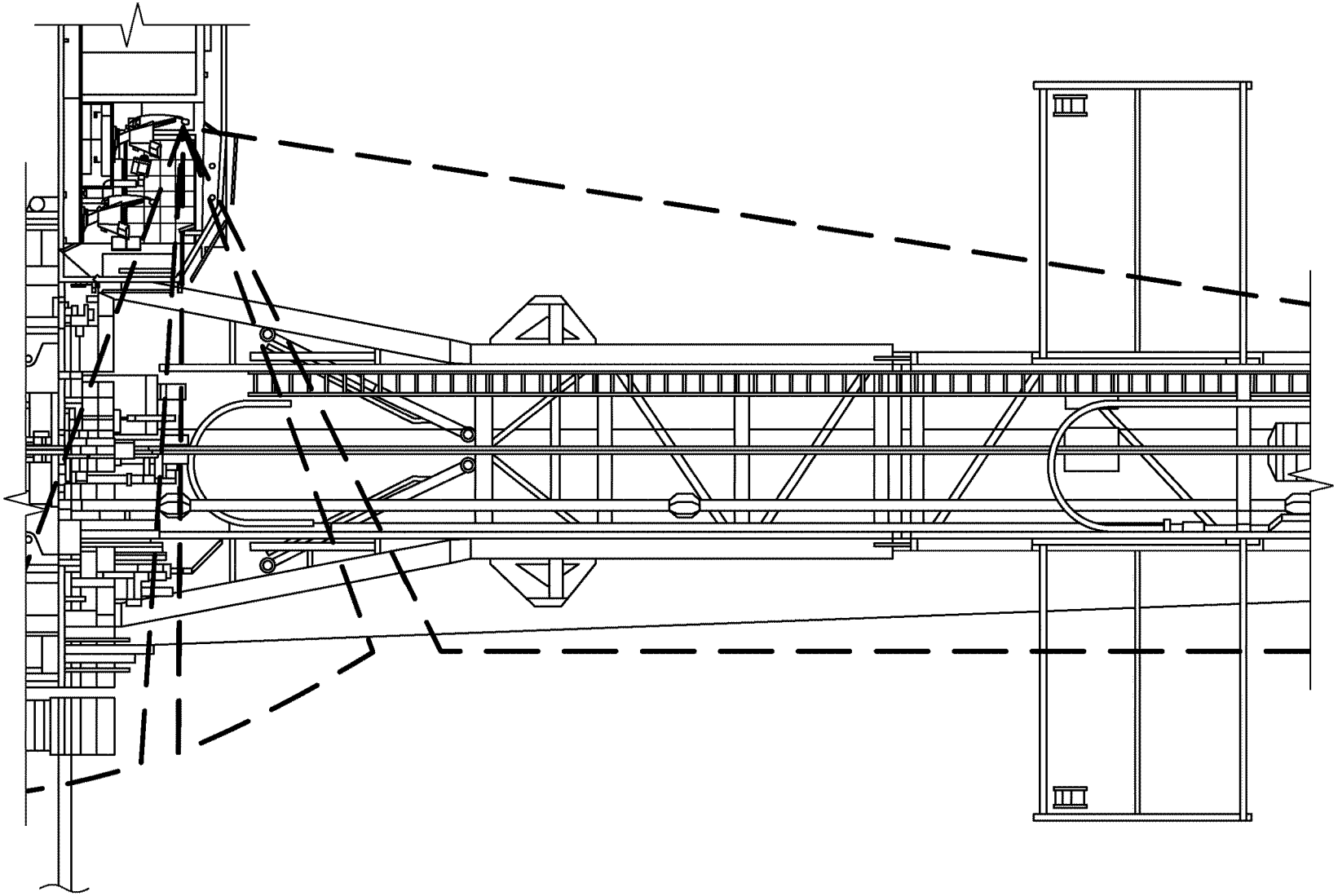
FIG. 7A illustrates vertical fields of vision for an operator seated in a rearward work station alcove in the work station enclosure of FIG. 3A.
Figure 7B:
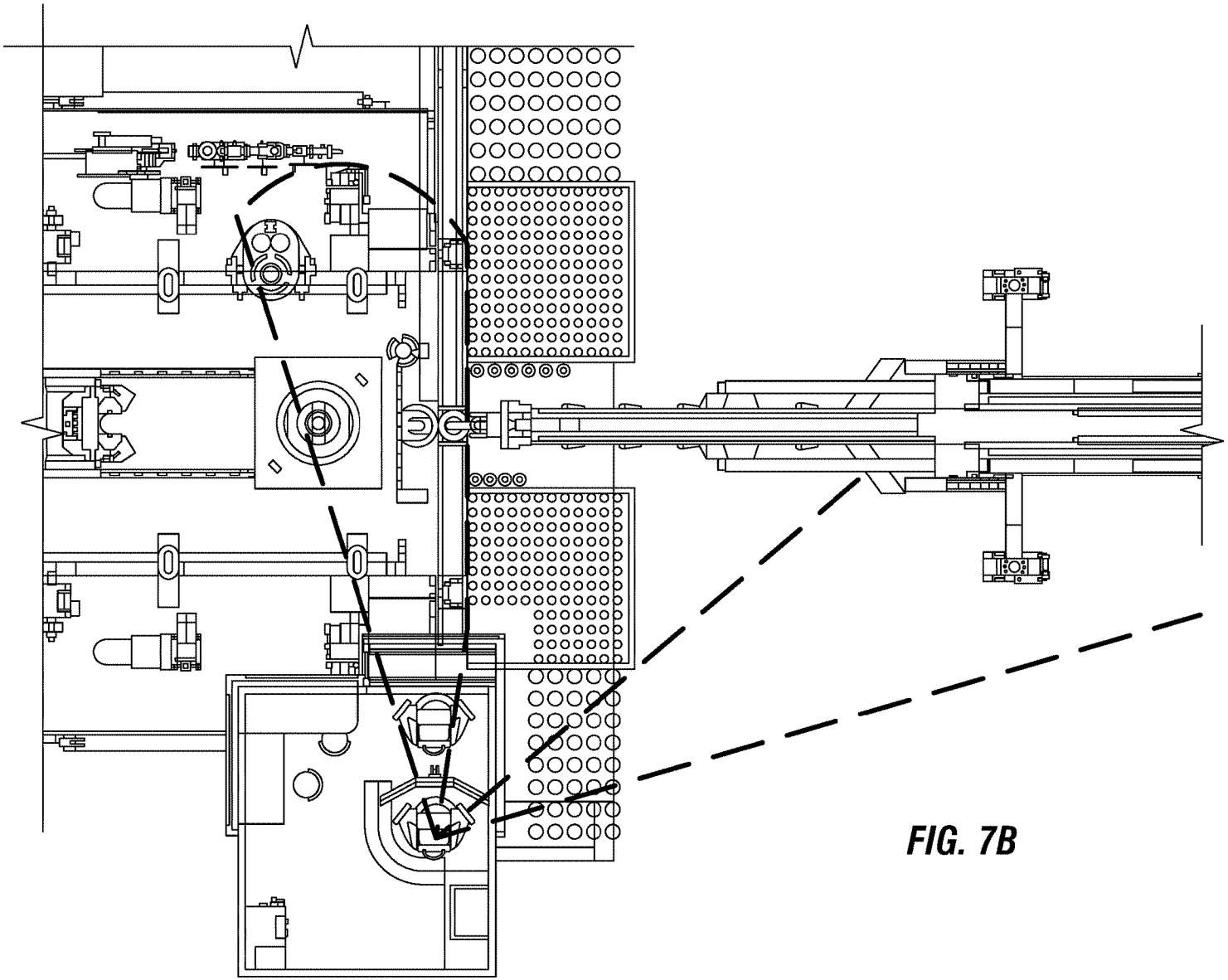
FIG. 7B illustrates horizontal fields of vision for an operator seated in a rearward work station alcove in the work station enclosure of FIG. 3A.

FIG. 7A illustrates a side view of a drilling rig with a control station (rabbit cage) 300 as shown in FIGS. 3A-3K, wherein the vertical fields of sight for the rearward operator are identified. FIG. 7B shows the horizontal fields of sight for the rearward operator in the same control station (rabbit cage) 300.

Figure 8A:
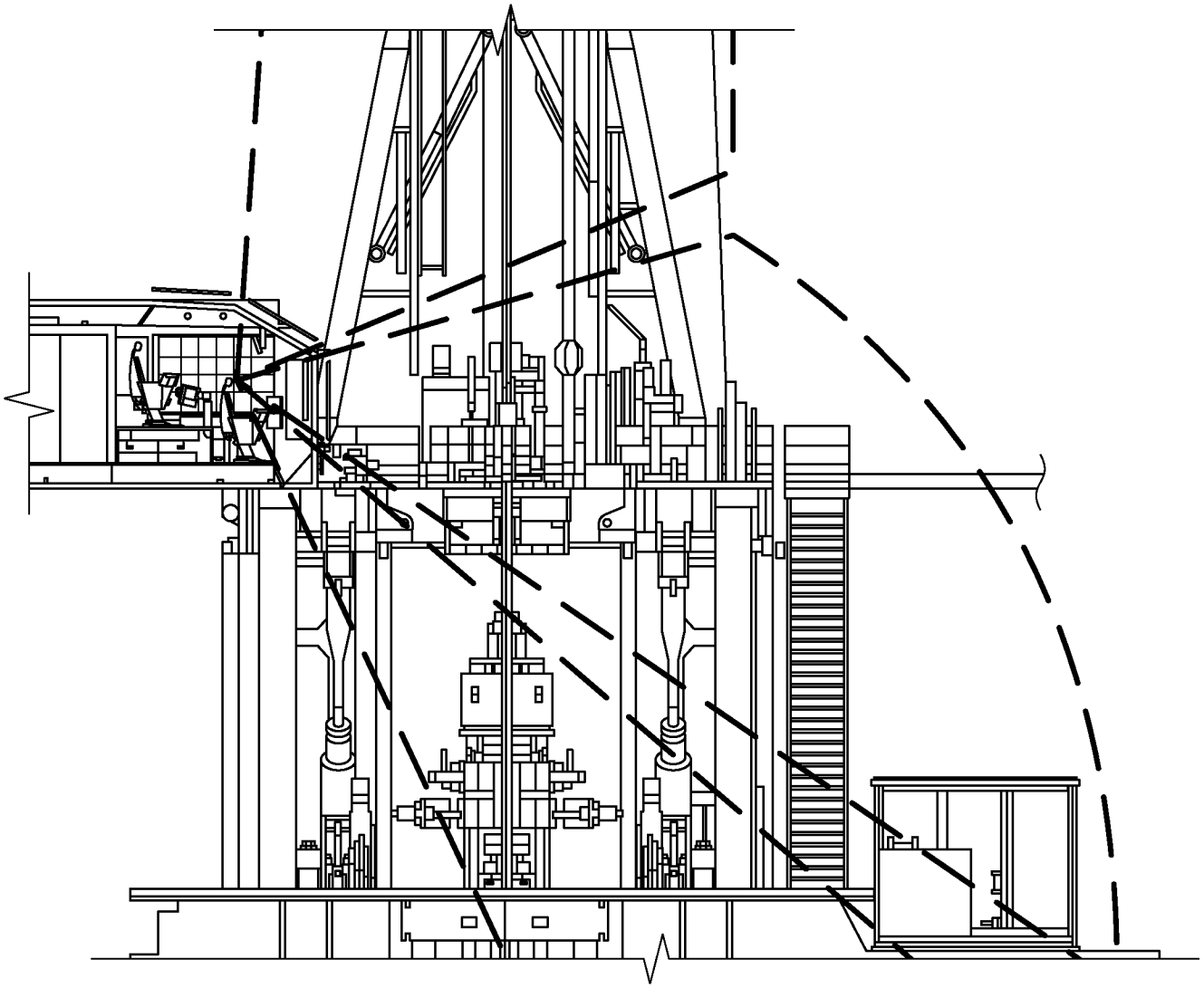
FIG. 8A illustrates vertical fields of vision for an operator seated in a forward work station alcove in the work station enclosure of FIG. 3A.
Figure 8B:
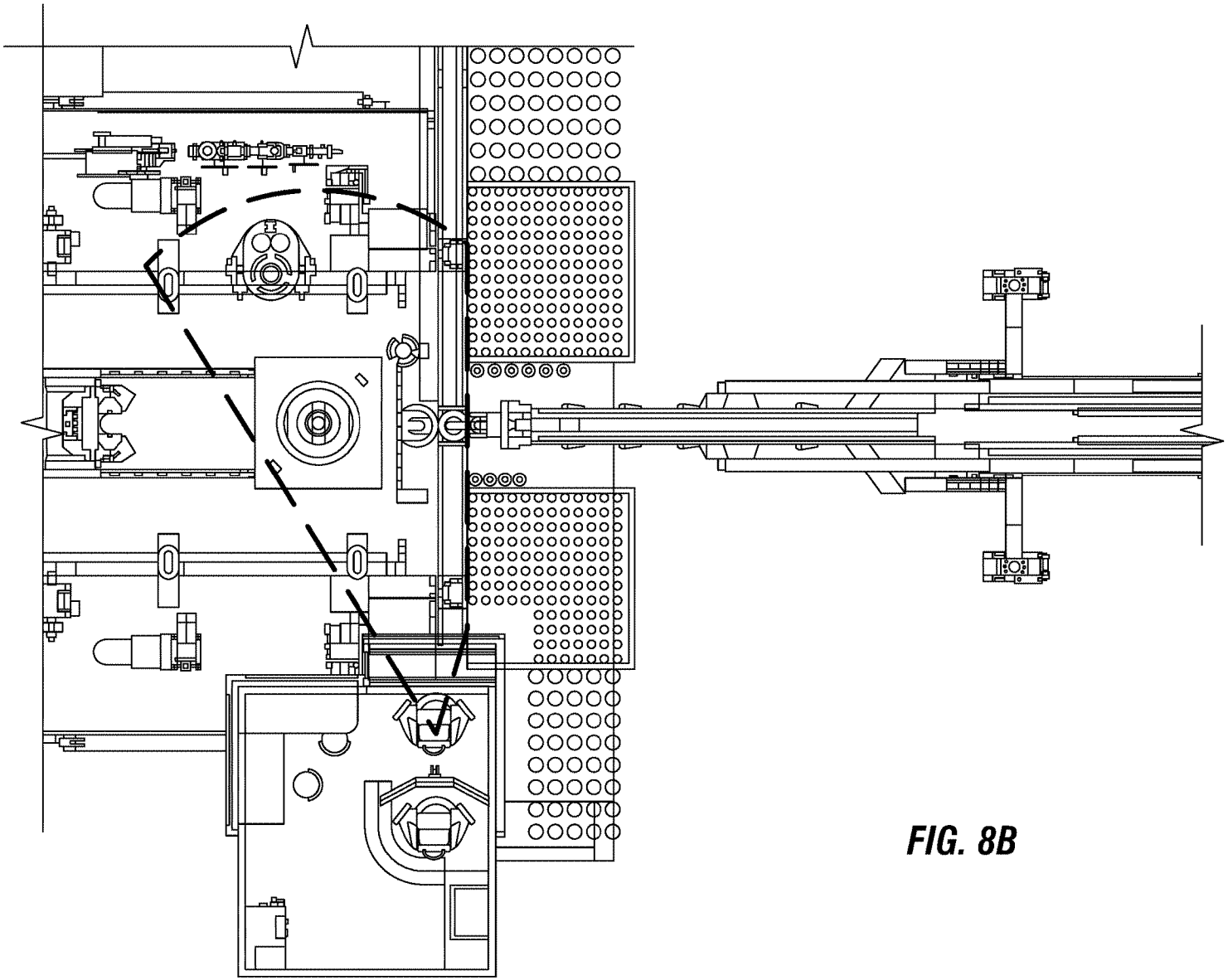
FIG. 8B illustrates horizontal fields of vision for an operator seated in a forward work station alcove in the work station enclosure of FIG. 3A.

FIG. 8A illustrates a side view of a drilling rig with a control station (rabbit cage) 300 as shown in FIGS. 3A-3K, wherein the vertical fields of sight for the forward operator are identified. FIG. 8B shows the horizontal fields of sight for the rearward operator in the same control station (rabbit cage) 300.

Figure 9:
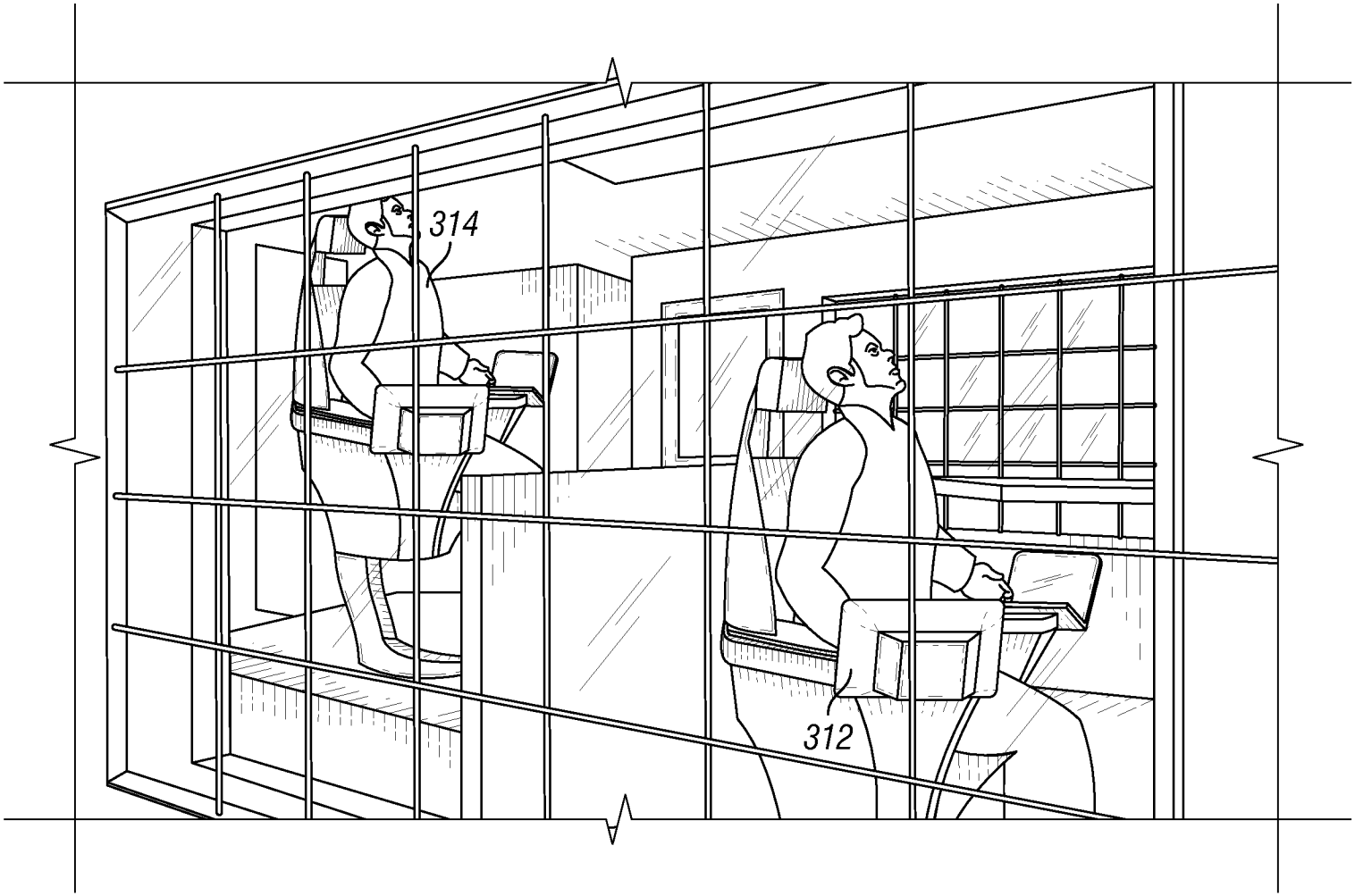
FIG. 9 shows a view into a side window of the work station enclosure of FIG. 3A, wherein forward and rearward work station alcoves are visible.

FIG. 9 shows a view of a control station (rabbit cage) 300 as shown in FIGS. 3A-3K, wherein the view is from the perspective of one looking from outside in through the side window so that both the forward operator alcove and the rearward operator alcove are visible. The rearward operator alcove is positioned higher relative to the forward operator alcove so that the rear operator may see over the fore operator.

Figure 10A:
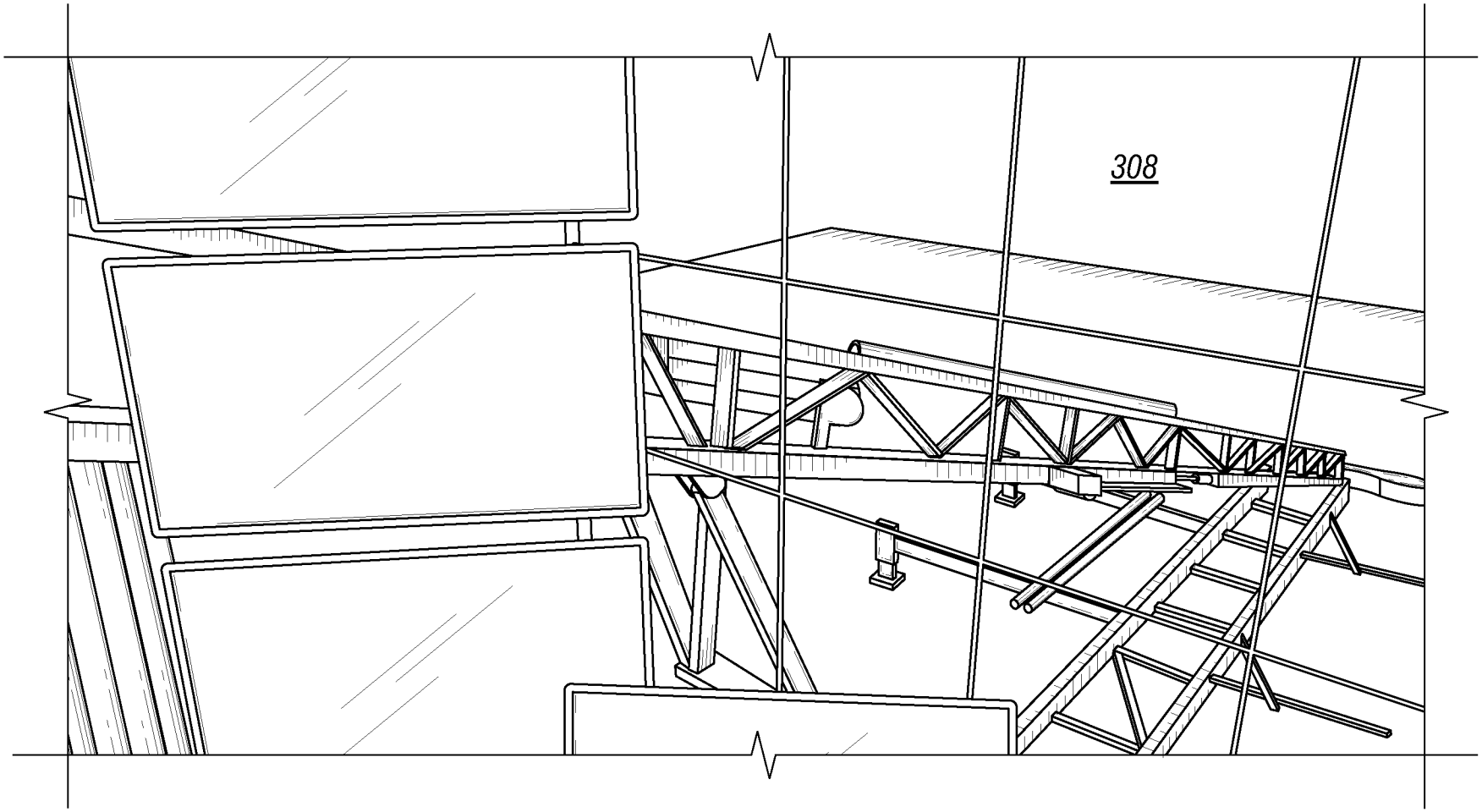
FIG. 10A shows a line of sight view from the perspective of an operator seated in a forward work station alcove of the work station enclosure of FIG. 3A looking out the right side window toward a catwalk machine.
Figure 10B:
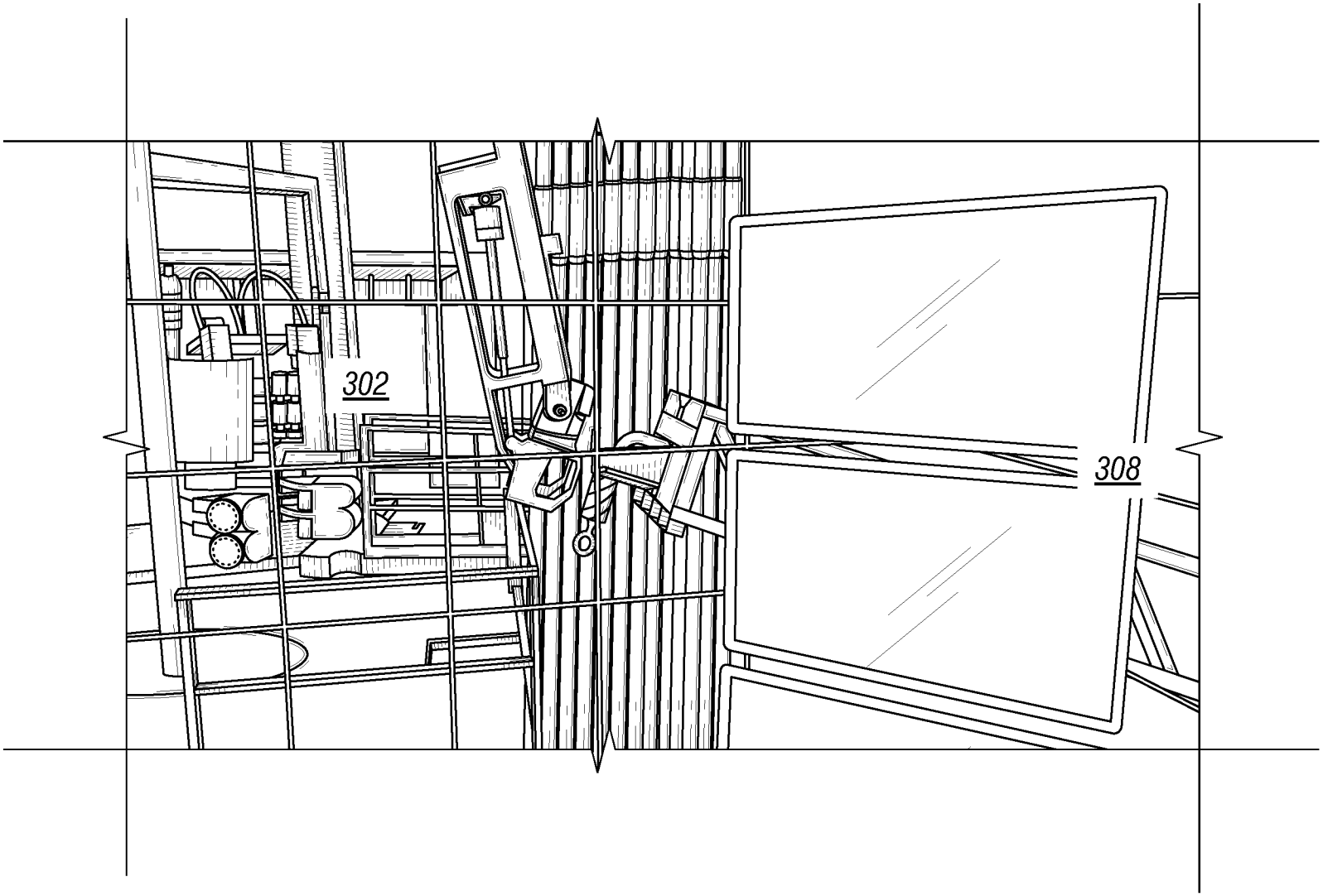
FIG. 10B shows a line of sight view from the perspective of an operator seated in a forward work station alcove of the work station enclosure of FIG. 3A looking out both the right side window toward a catwalk machine and the front window toward stand building machines.
Figure 10C:
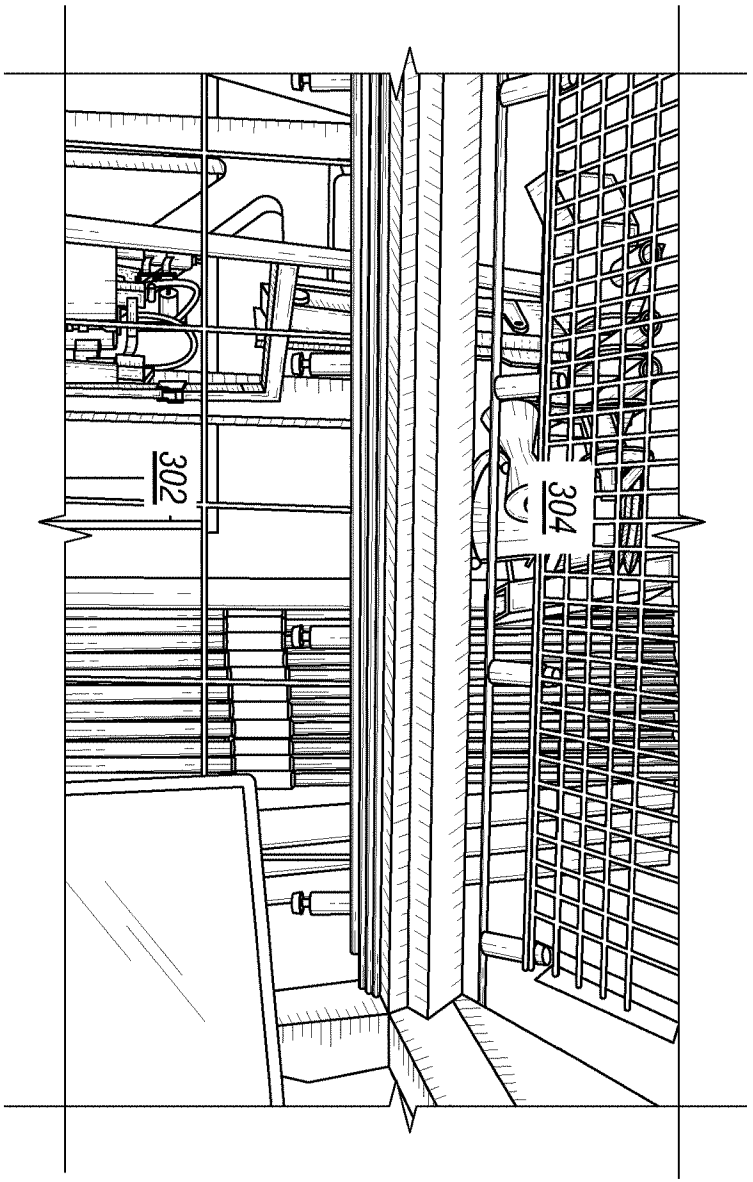
FIG. 10C shows a line of sight view from the perspective of an operator seated in a forward work station alcove of the work station enclosure of FIG. 3A looking out both the front window toward iron roughnecks and the forward top window toward an iron roughneck pipe tong and lower stabilizing arm LSA.
Figure 10D:
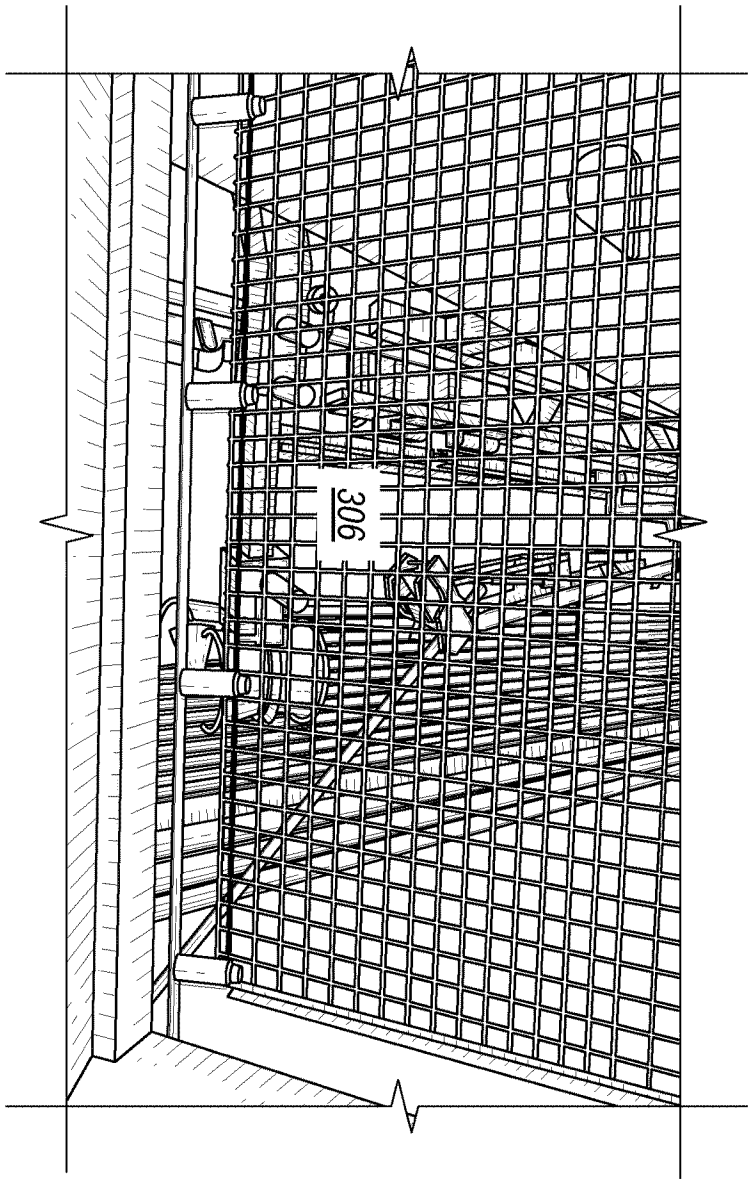
FIG. 10D shows a line of sight view from the perspective of an operator seated in a forward work station alcove of the work station enclosure of FIG. 3A looking out the forward top window toward a tubular delivery arm TDA and lower stabilizing arm LSA.

FIGS. 10A-10D illustrate views of the drilling rig from the perspective of an operator seated in the forward control alcove. FIG. 10A shows a view looking out the side window of the control station (rabbit cage) 300 toward the catwalk. FIG. 10B shows a view looking out the forward window of the control station (rabbit cage) 300 toward the drill rig floor and stand building stations. FIG. 10C shows a view looking partially out the forward window and partially out the roof window of the control station (rabbit cage) 300 toward the drill and stand building equipment. FIG. 10D shows a view looking out the roof window of the control station (rabbit cage) 300 toward the drill rig mast and stand building equipment.

Figure 11A:
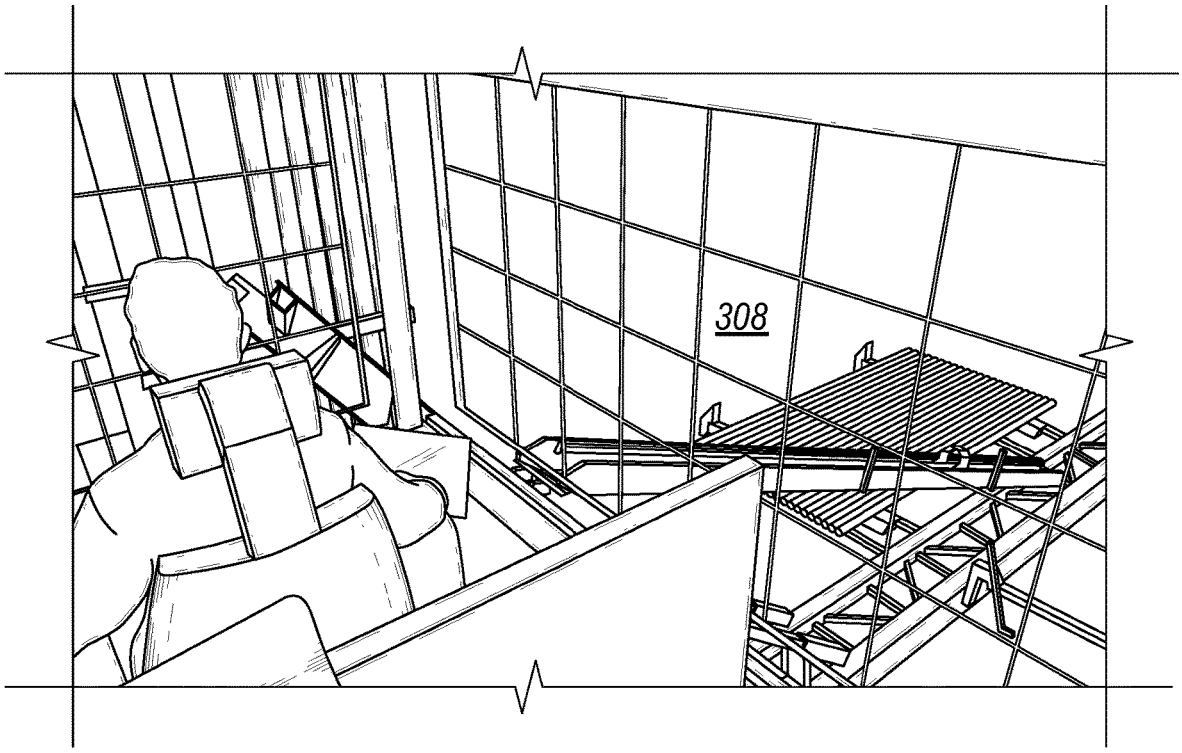
FIG. 11A shows a line of sight view from the perspective of an operator seated in a rearward work station alcove of the work station enclosure of FIG. 3A looking out the right side window toward a catwalk machine.
Figure 11B:
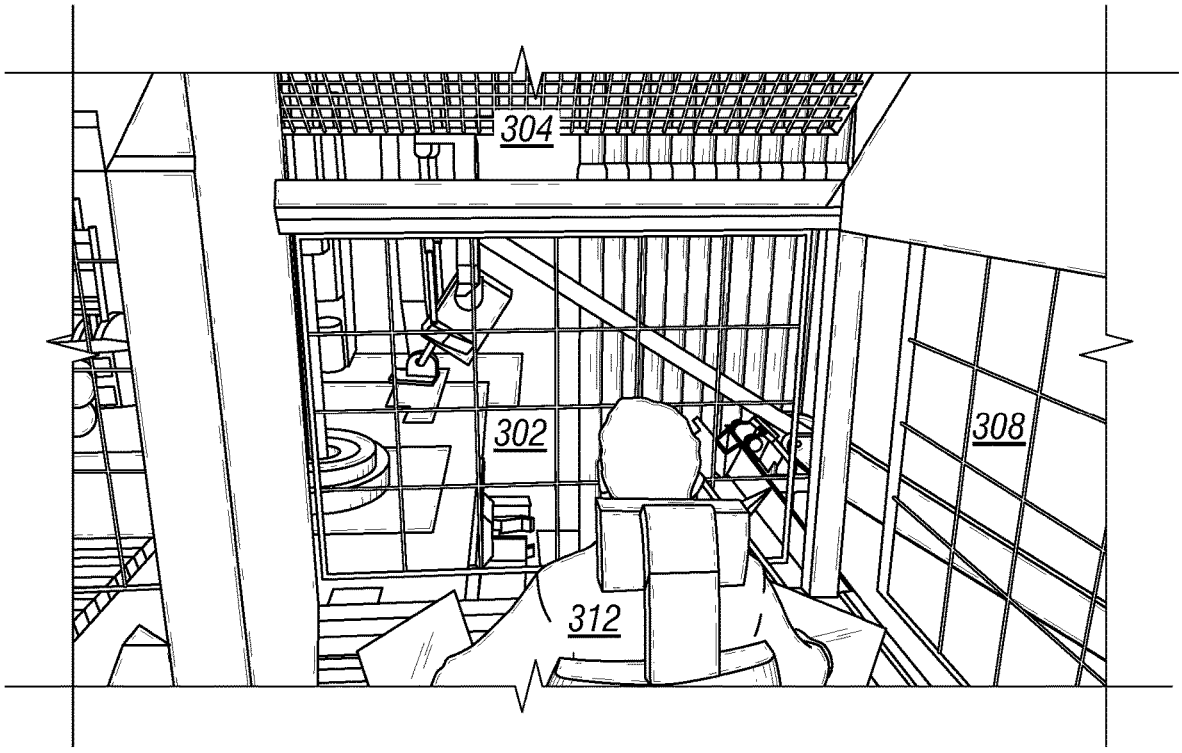
FIG. 11B shows a line of sight view from the perspective of an operator seated in the rearward work station alcove of the work station enclosure of FIG. 3A looking out both the right side window toward a catwalk machine and the front window toward stand building machines.
Figure 11C:
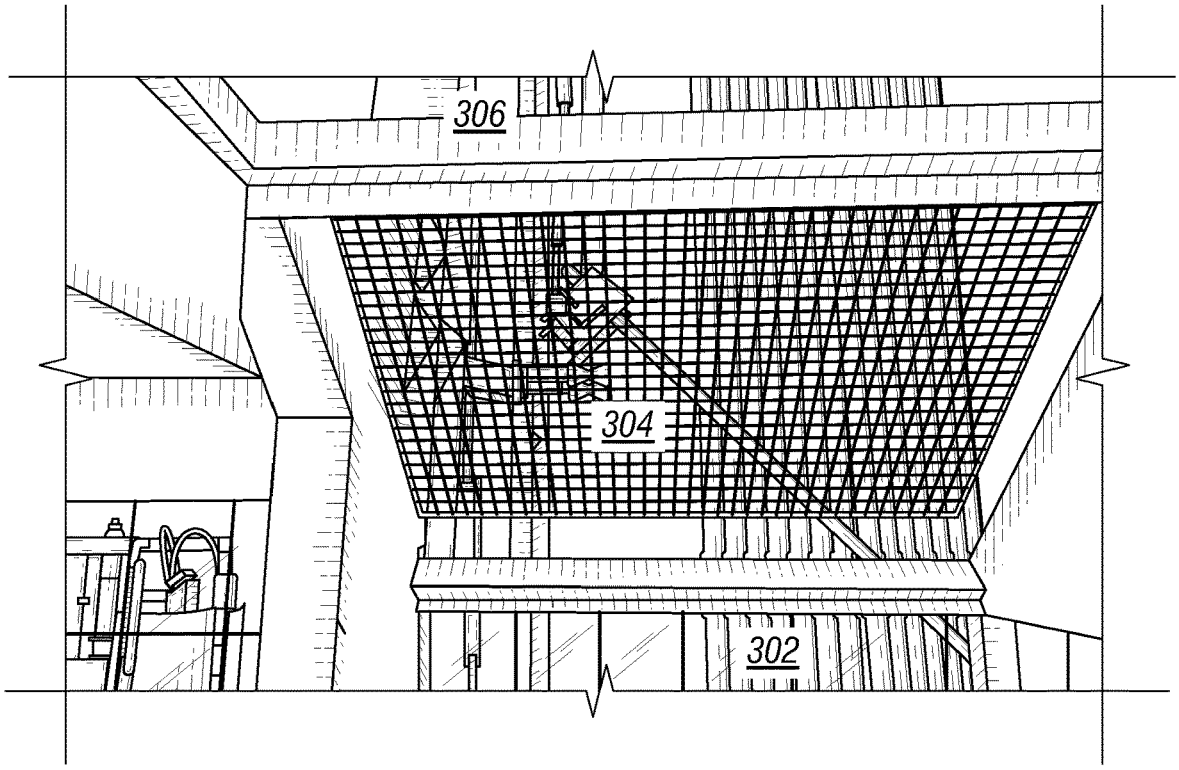
FIG. 11C shows a line of sight view from the perspective of an operator seated in a rearward work station alcove of the work station enclosure of FIG. 3A looking out the front, forward top, and rearward top windows toward a tubular delivery arm TDA and a lower stabilizing arm LSA.
Figure 11D:
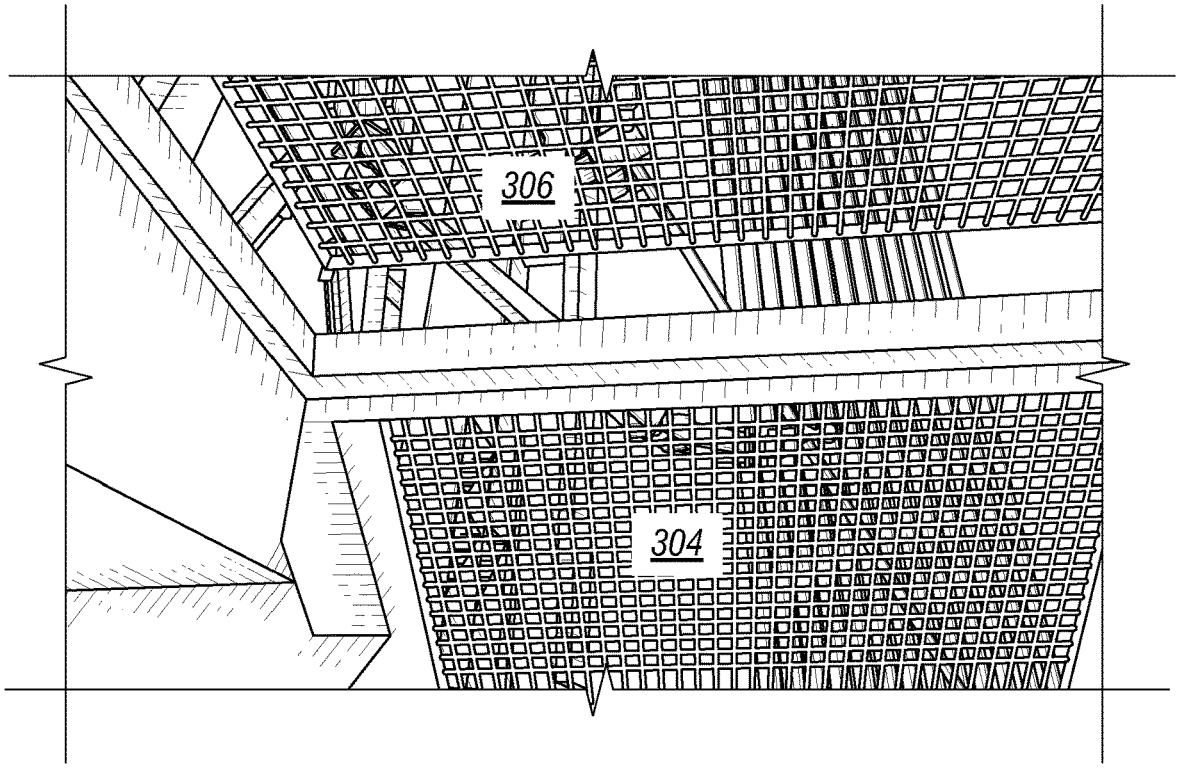
FIG. 11D shows a line of sight view from the perspective of an operator seated in a rearward work station alcove of the work station enclosure of FIG. 3A looking out the forward and rearward top windows toward a tubular delivery arm TDA and lower stabilizing arm LSA.

FIGS. 11A-11D illustrate views of the drilling rig from the perspective of an operator seated in the rearward control alcove. The rearward control alcove may be for the driller. FIG. 11A shows a view looking out the side window of the control station (rabbit cage) 300 toward the catwalk. FIG. 11B shows a view looking out the forward window of the control station (rabbit cage) 300 toward the drill rig floor and stand building stations. FIG. 11C shows a view looking partially out the forward window, out the forward roof window, and partially out the rearward roof window of the control station (rabbit cage) 300 toward the drill and stand building equipment. FIG. 11D shows a view looking partially out the forward roof window and partially out the rearward roof window of the control station (rabbit cage) 300 toward the drill rig mast and stand building equipment.

Figure 12:
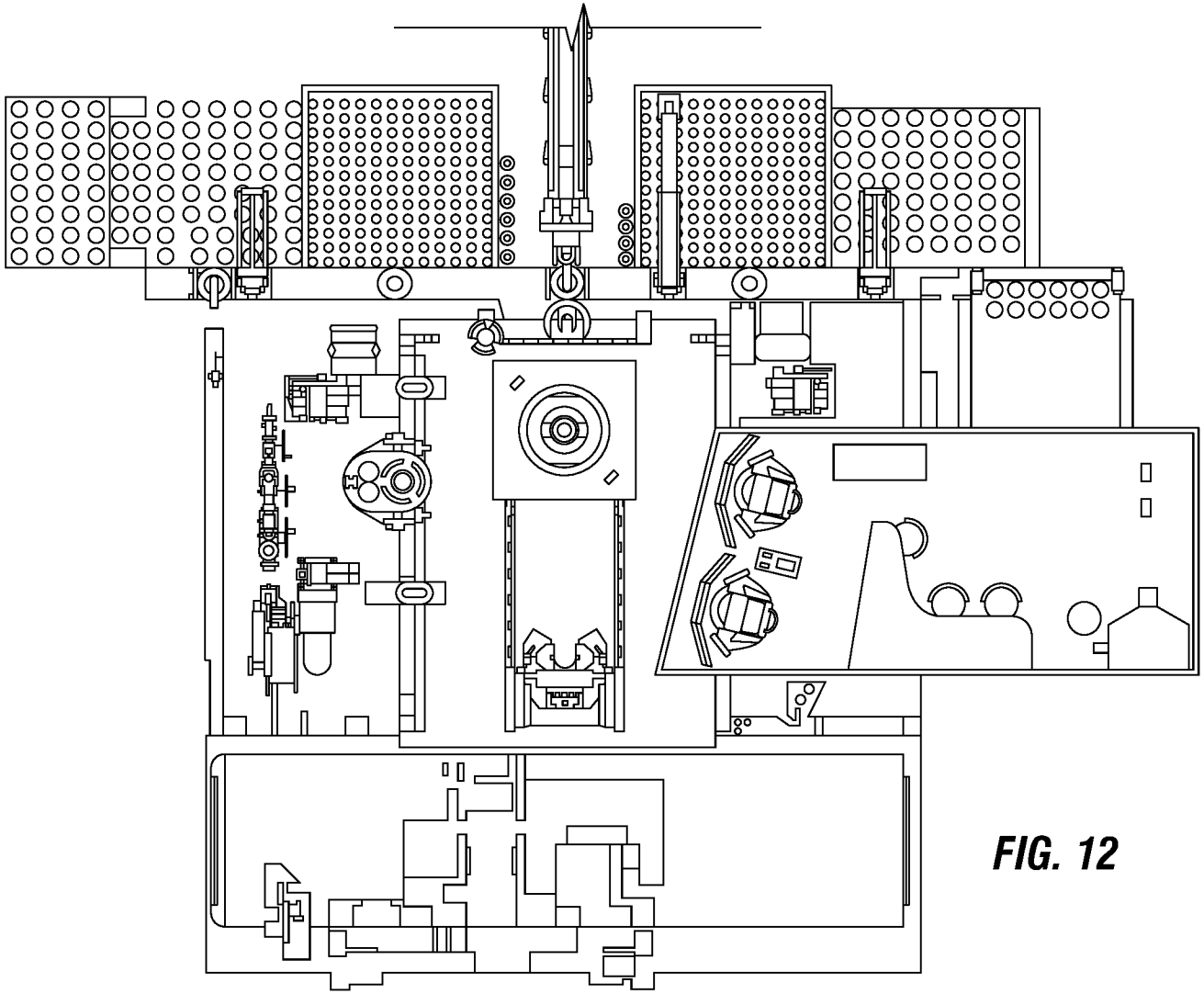
FIG. 12 shows a floorplan for a rig floor and workstation enclosure, wherein the work station alcoves are side-by-side.
Figure 13:
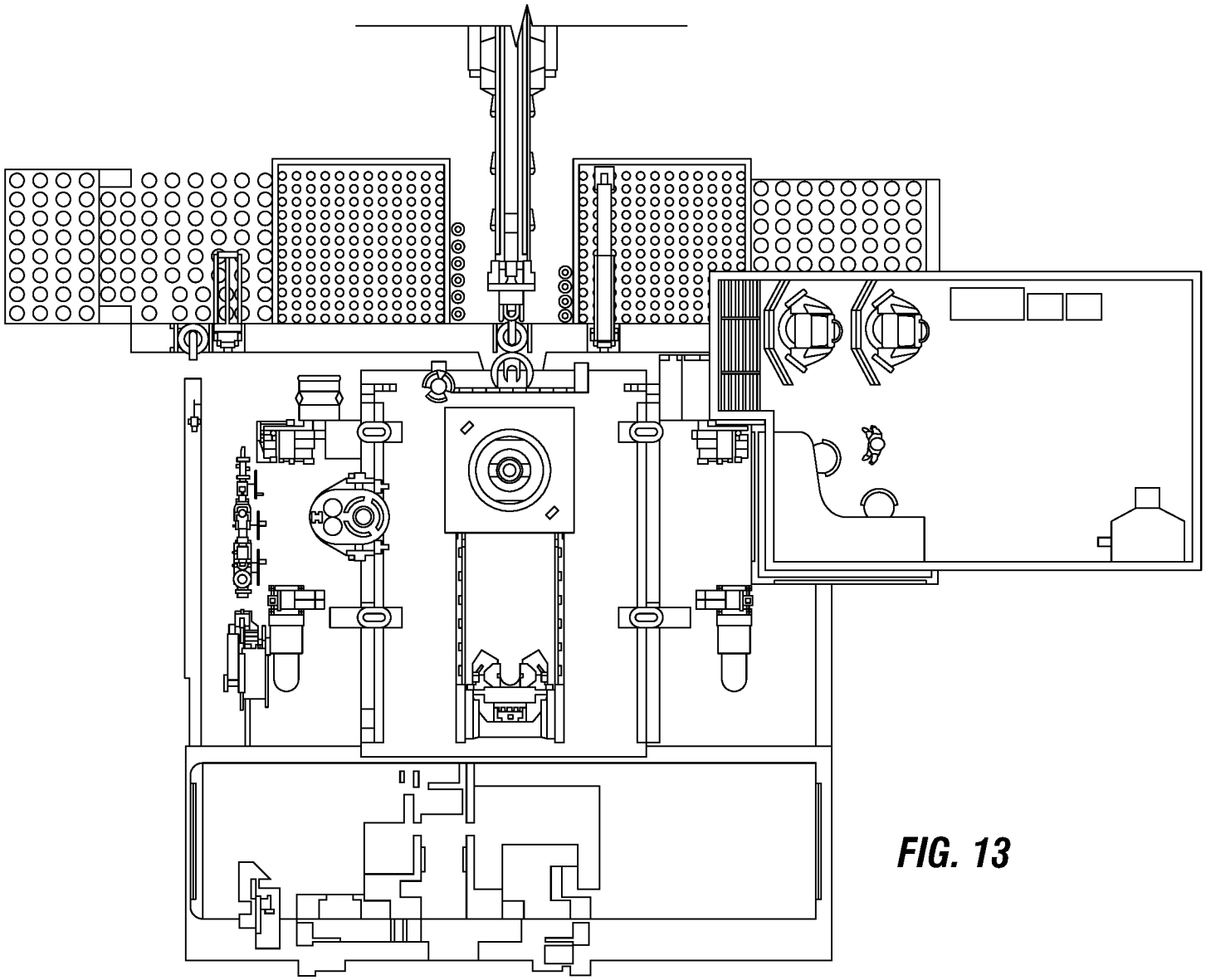
FIG. 13 shows a floorplan for a rig floor and workstation enclosure, wherein the work station alcoves are one in front of the other.

The control station (rabbit cage) may be positioned relative to the drill floor of the drilling rig to provide optimal lines of sight. FIG. 12 illustrates a drill floor layout with a control station (rabbit cage) of FIGS. 4A-4B positioned relative thereto. FIG. 13 illustrates a drill floor layout with a control station (rabbit cage) of FIGS. 3A-3K positioned relative thereto. Regarding lines of sight, the control station (rabbit cage) 300 may be designed and positioned to allow the operator or operators a light of sight to the top drive elevator handoff location, a line of sight to the APH operation below the drilling floor, and a further line of sight to the drilling floor. Two operations may be going on simultaneously: drilling and stand building. Thus, the operators should have full visibility to monitor both operations.

The control station (rabbit cage) 300 may be a module for assembly with other modular components of the drilling rig. It may provide an operating temperature to the occupants via heating/cooling systems controlled by DR/AD, wherein these systems may be redundant. Lights may be sufficient and dimmable. Window panels may be anti-glare, sunscreen, window cleaning. The construction of the control station may be such that noise dampening may be 20 dB reduction compared to drill floor noise. The construction may also avoid the need for pressurized cabin even with windwalls. Vibration dampening (cabinets and operator chairs) may also be provided. There may be seamless integration of planck/symphony. The control station (rabbit cage) 300 may have a maximum capacity of five persons, wherein there is room inside DCR for two-three persons in addition to two operators. A situation response room may be collaborative with space on the rig floor. Working stations may be provided as a separate desk and workstation. There may be two operator chairs. There may be redundant controls. Access and exit may be via two doors, outside zone two, dual escape routes for DR/AD. (See FIGS. 3A, 3C, 3H, 4A, 4B, 3J, and 5). There may be DCR-Displays with room for extra screens. A BOP control panel may be positioned so as to be easily accessible for all in the room. The control station (rabbit cage) 300 may be designed around the operators with consideration for well construction machine vision. It may be designed with consideration that there is a potential for dropped objects to fall on top of the DCR in view of the machinery moving above. A LER may be enabled on the driller side of the drill floor.

Figure 14:
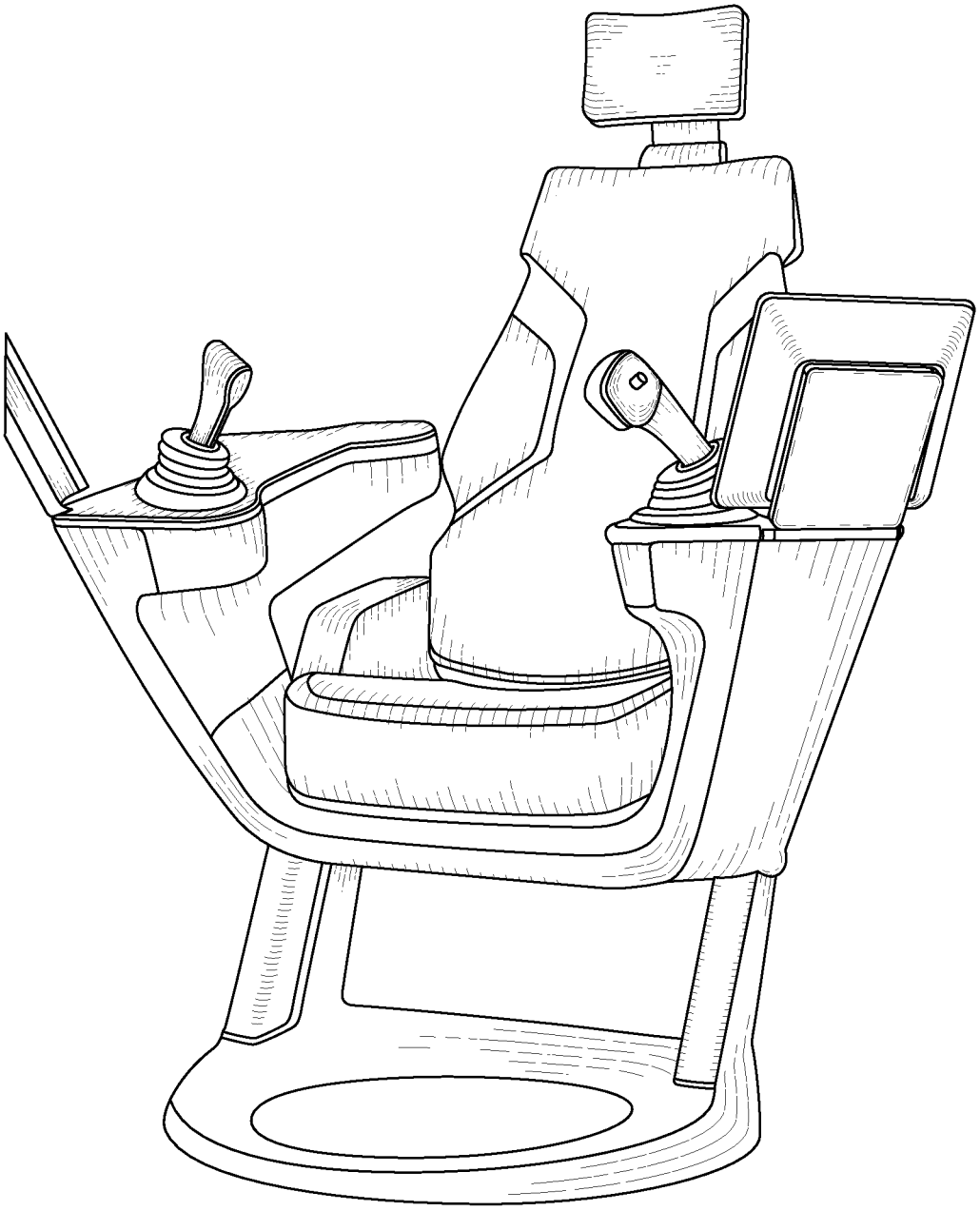
FIG. 14 shows a perspective view of an operator's chair for a work station alcove.

FIG. 14 shows a perspective view of an operator chair for use in the control alcoves. All equipment controls may be integrated to the chair so that everything is easily available at arm's reach.

Figure 15:
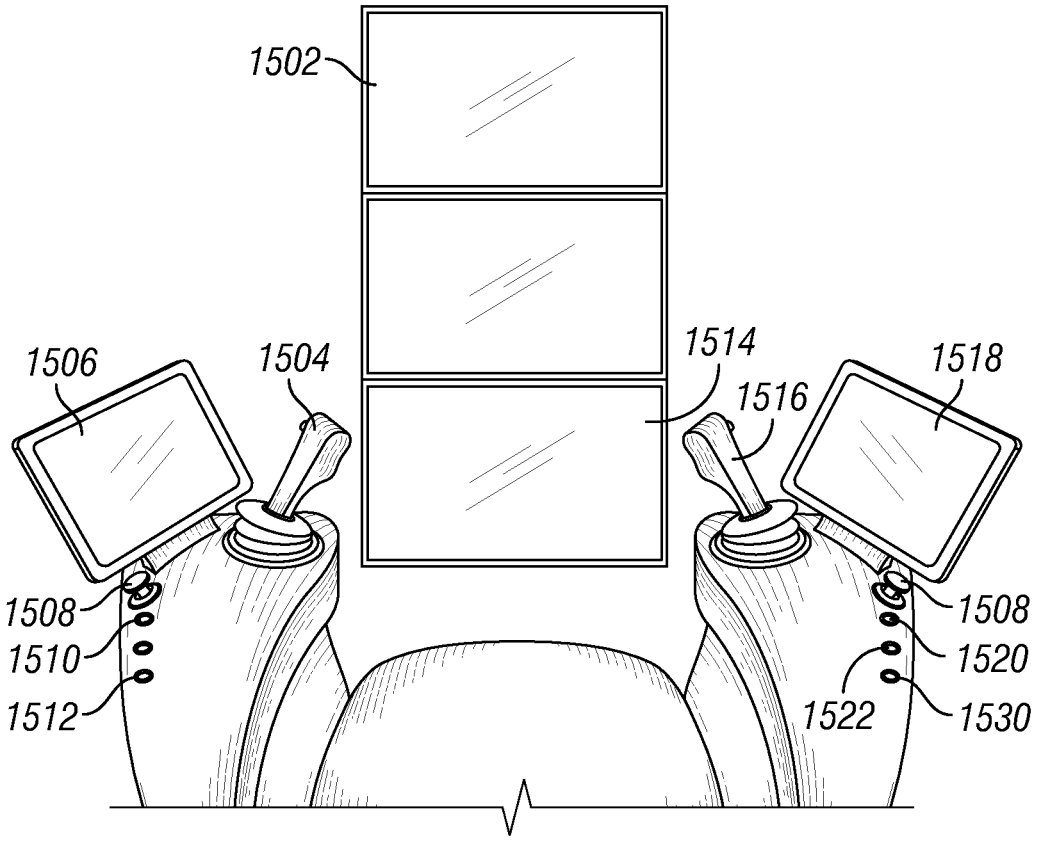
FIG. 15 shows a view from the perspective of an operator seated in an operator's chair as shown in FIG. 14, wherein three displays are positioned in front of the chair as part of the alcove.

FIG. 15 shows a control alcove from the perspective of an operator. The controls may be the most intuitive HMI. Touchpads 1518 may be used for control of equipment. Symbols and text may be used on each button. Feedback status may be provided on buttons. The operator chair may provide very intuitive and safe operation. Control systems may be software based—so they may easily be changed. Front HMI screens 1502 may be provided with a comfortable look and feel, which may be less noisy than other vendors. A CCTV screen 1514 may also be provided. The front HMI screens 1502 may be controlled by mouse-roller ball 1522 with a right click feature on the mouse 1520 so as to provide more ergonomic control and more precise control of screen objects. Three Front HMI Screens 1502 may be used to as to not interfere with optimal line-of-sight. (See FIGS. 10A-10B). With outstanding ergonomic adjustments, operators may be able to maintain stress-free 24/7 operation of the rig. Dimming on all screens may provide for optimal visibility in all conditions. Right and left joysticks 1504, control buttons 1506 and analogue control knob 1508 may provide control interface with the system. An alarm acknowledge button 1510 and E-stops 1512 may be provided. The functionality of each operator control alcove is completely interchangeable and configurable. In particular, control of individual drilling subsystems may be controlled by either operator control alcove and control may be switched from once operator control alcove to another.

Figure 16:
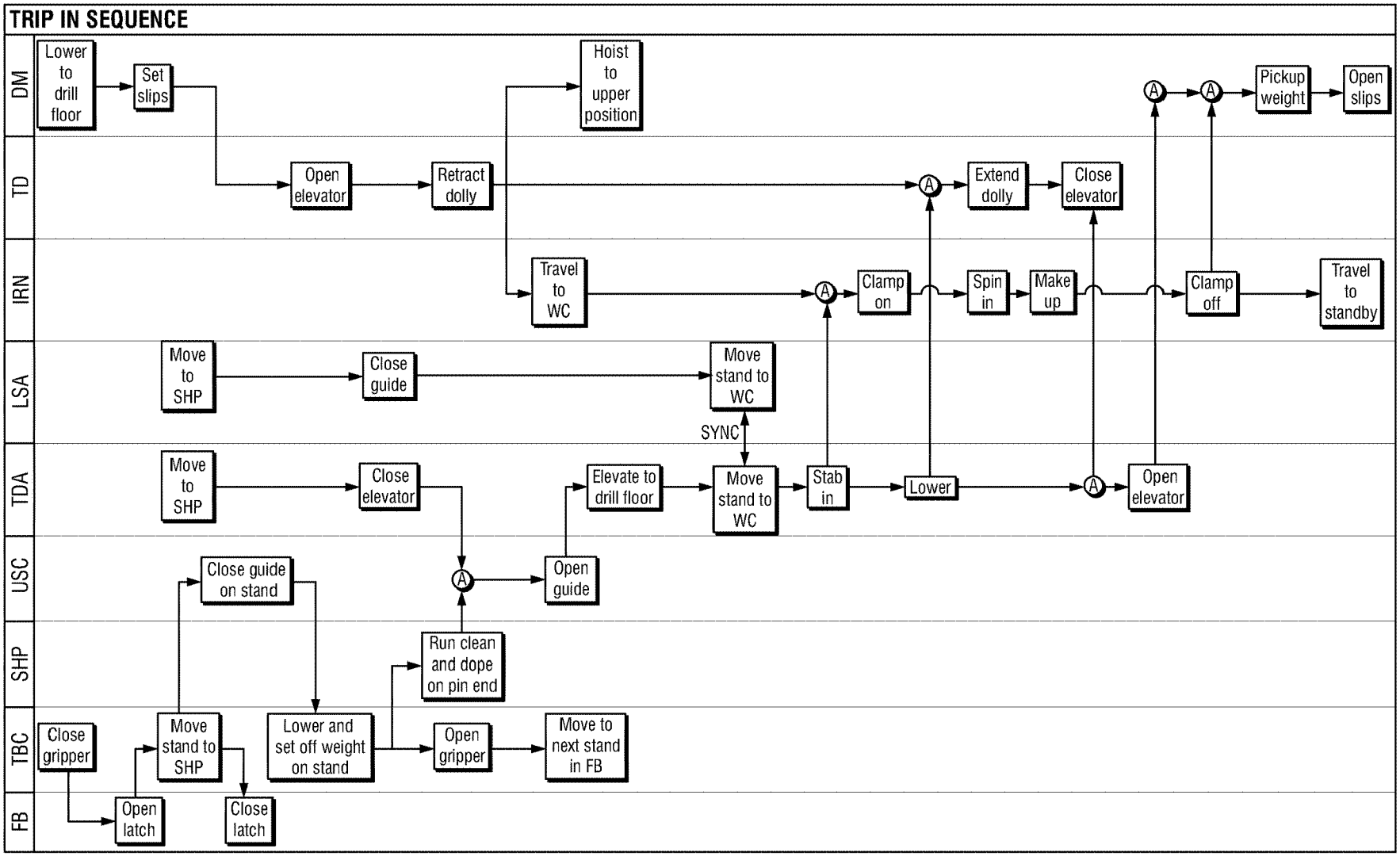
FIG. 16 shows a flow diagram for a tripping in process.

FIG. 16 shows a process flow diagram for tripping pipe into the wellbore. A drawwork DW lowers a travelling block to the drill floor and a transfer bridge constraint (racker) TBC closes a gripper on a stand of pipe in a finger board FB. The finger board RB opens a latch retaining the stand of pipe. A transfer bridge constraint (racker) TBC moves the stand of pipe to the stand handoff position SHP. The drawworks DW set slips. Both the lower stabilizing arm LSA and the tubular deliver arm TDA move the stand of pipe to the stand handoff position SHP and the finger board FB closes the latch. The upper stand constraint USC closes a guide around the stand of pipe. The top drive TD opens an elevator to release the drill string already tripped in the well and the transfer bridge constraint (racker) TBC lowers and sets off the weight of the pipe stand. The lower stabilizing arm LSA closes a guide and the tubular deliver arm TDA closes an elevator on the stand of pipe in the stand handoff position SHP. The top drive TD retracts its dolly to remove the top drive TD from the well center position WC. The stand handoff position SHP cleans and dopes the pin end of the pipe stand. The transfer bridge constraint (racker) then opens its gripper to release the pipe stand and moves to the next stand in the finger board FB. The pipe tong IRN travels to the well center position WC and the upper stand constraint USC opens its guide to release the pipe stand in the stand handoff position SHP. The tubular delivery arm TDA elevates to the drill floor and the drawwork DW hoists the top drive TD to an upper position in the mast. Both the lower stabilizing arm LSA and the tubular deliver arm TDA move the stand of pipe to the well center position WC, and the tubular deliver arm TDA stabs the pipe stand into the drill string. The pipe tong IRN clamps onto the drill string. The tubular deliver arm TDA lowers the pipe stand as the pipe tong IRN spins the pipe strand to thread the pin end of the pipe strand into the box end of the drill string. Meanwhile, the top drive extends its dolly to position the top drive TD over the drill sting and pipe stand at the well center position WC. As the pipe tong IRN makes-up the connection between the drill string and the pipe stand, the top drive TD closes its elevator around the made up pipe stand. The tubular deliver arm TDA then opens its elevator to release the made up pipe stand. The pipe tong IRN clamps off the drill string as the drawworks DW picks up the weight of the drill string and the pipe tong IRN travels to its standby position as the drawworks DW opens the slips so that the drill string is suspended by the top drive TD.

Figure 17:
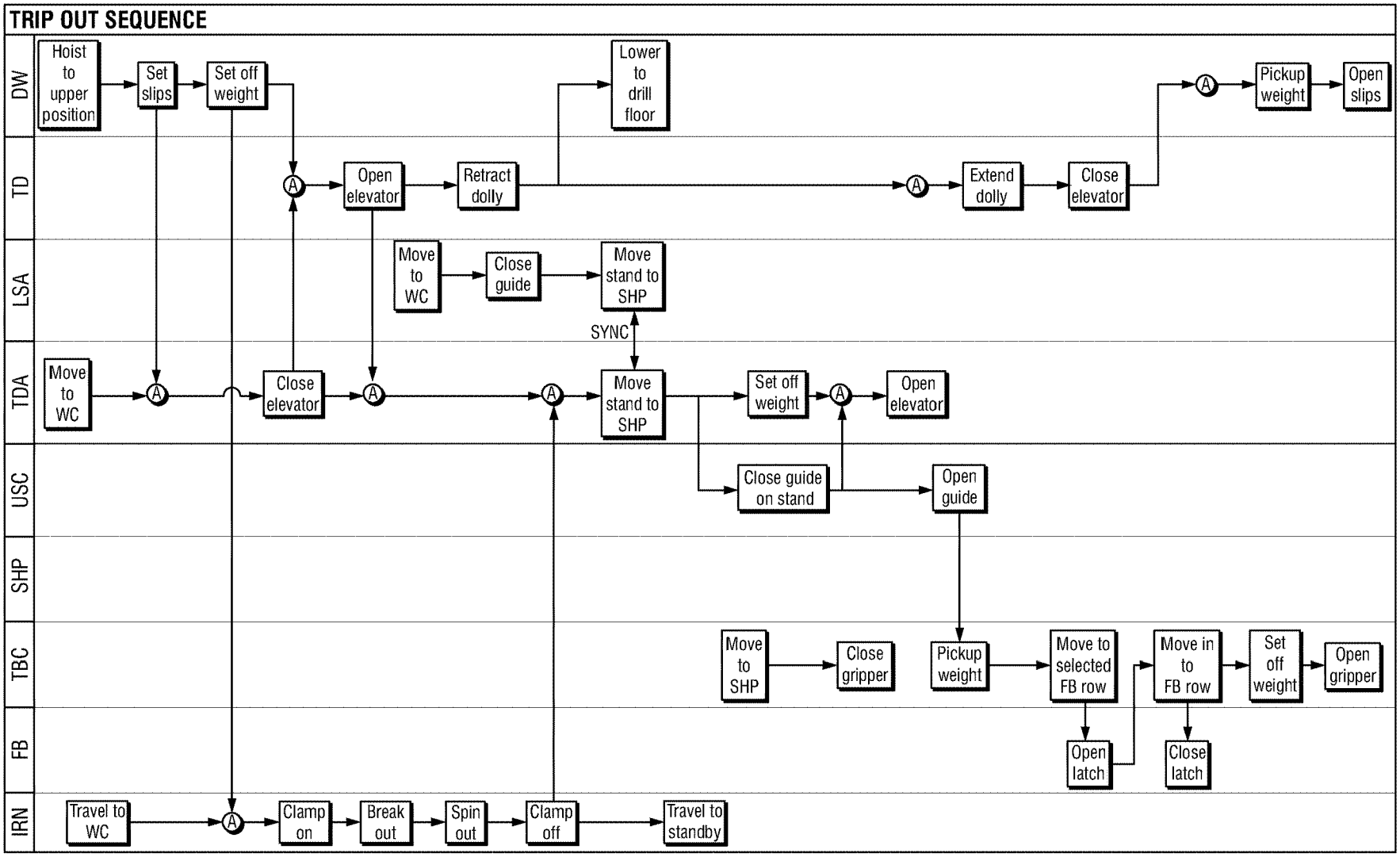
FIG. 17 shows a flow diagram for a tripping out process.

FIG. 17 shows a process flow diagram for tripping pipe out of the wellbore. A drawwork DW hoists the top drive TD to an upper position with the drill string suspended from a top drive TD elevator. Both the pipe tong IRN and the tubular delivery arm TDA travel to the well center position WC. The drawwork sets slips and sets off the weight of the drill string to suspend the drill string from the drill rig floor. The tubular delivery arm TDA closes its elevator around the top of the top stand made up in the drill string as the pipe tong IRN clamps on to the drill string. The top drive TD then opens its elevator as the pipe tong IRN breaks out the connections between the upper pipe stand and the rest of the drill string. The lower stabilizing arm LSA moves to the well center position WC. The top driver TD retracts from the well center position as the pipe tong IRN spins out the connection. The lower stabilizing arm LSA closes its guide around the pipe stand. The pipe tong IRN clamps off the drill string. The drawworks DW lowers the top drive TD to the drill rig floor as both the lower stabilizing arm LSA and the tubular delivery arm TDA move the pipe stand to the stand handoff position SHP. The pipe tong IRN returns to its standby position and the transfer bridge constraint (racker) TBC moves to the stand handoff position SHP. The tubular delivery arm TDA sets off the weight of the pipe stand in the stand handoff position SHP as the upper stand constraint USC closes its guide on the pipe stand. The transfer bridge constraint (racker) TBC then closes its gripper on the pipe stand and the tubular delivery arm TDA opens its elevator. As the transfer bridge constraint (racker) TDC picks up the weight of the pipe stand, the upper stand constraint USC opens its guide. Having been lowered to the drill rig floor, the top drive TD extends dolly to position the top drive over the well center position WC. The top drive TD then closes its elevator on the drill string as the transfer bridge constraint (racker) TBC moves the pipe stand to a selected finger board FB row and the finger board FB opens a latch. The transfer bridge constraint (racker) TBC moves the pipe stand into the selected finger board FB row and the finger board FB closes the latch behind the pipe stand. The transfer bridge constraint (racker) TBC sets off the weight of the pipe stand in the setback and opens its gripper to release the pipe stand.

The drawworks DW picks up the weight of the drill string and opens the slips in the drill rig floor.

Figure 18A:
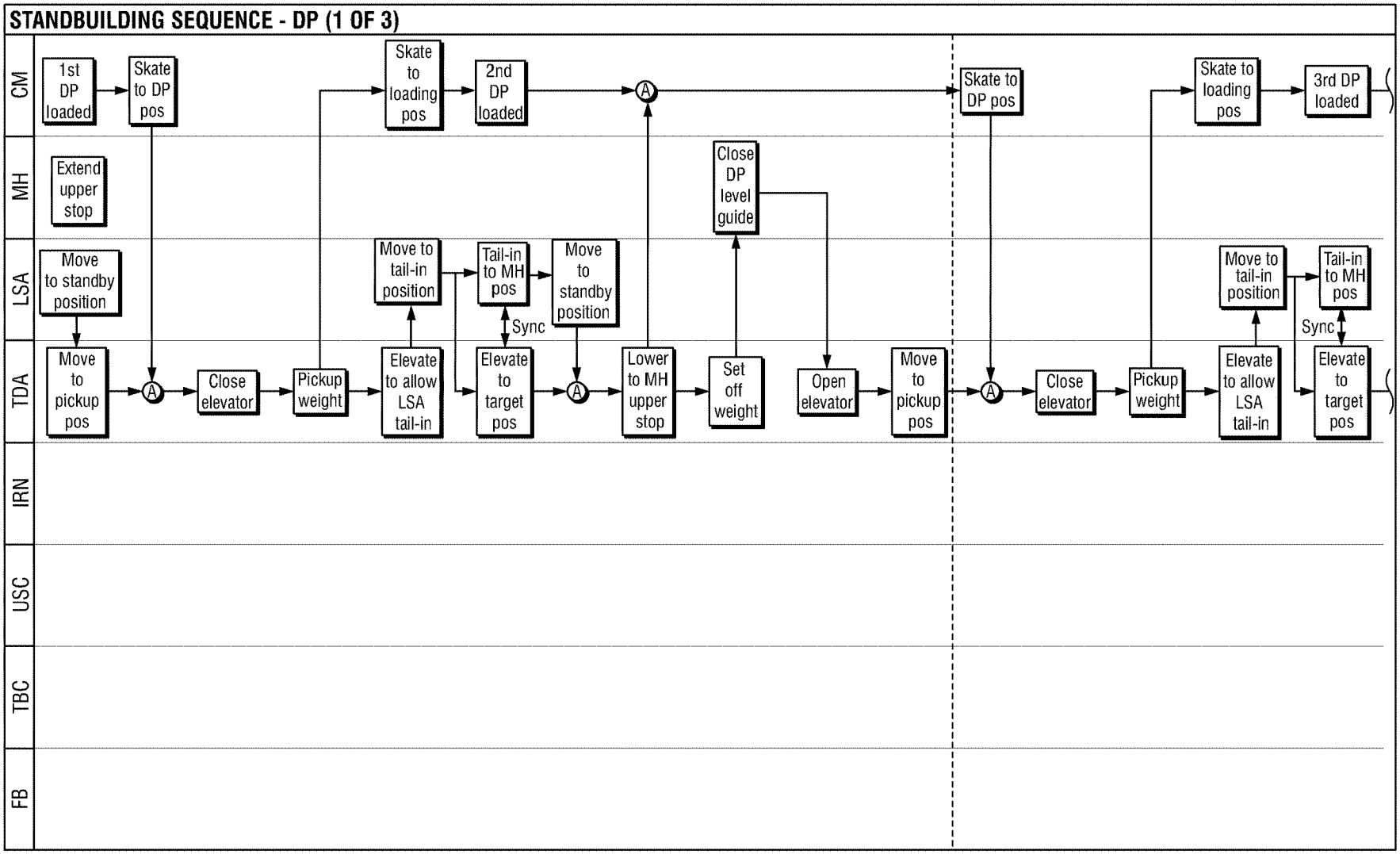
FIGS. 18A-18C show a flow diagram for a drill pipe standbuilding process.
Figure 18B:
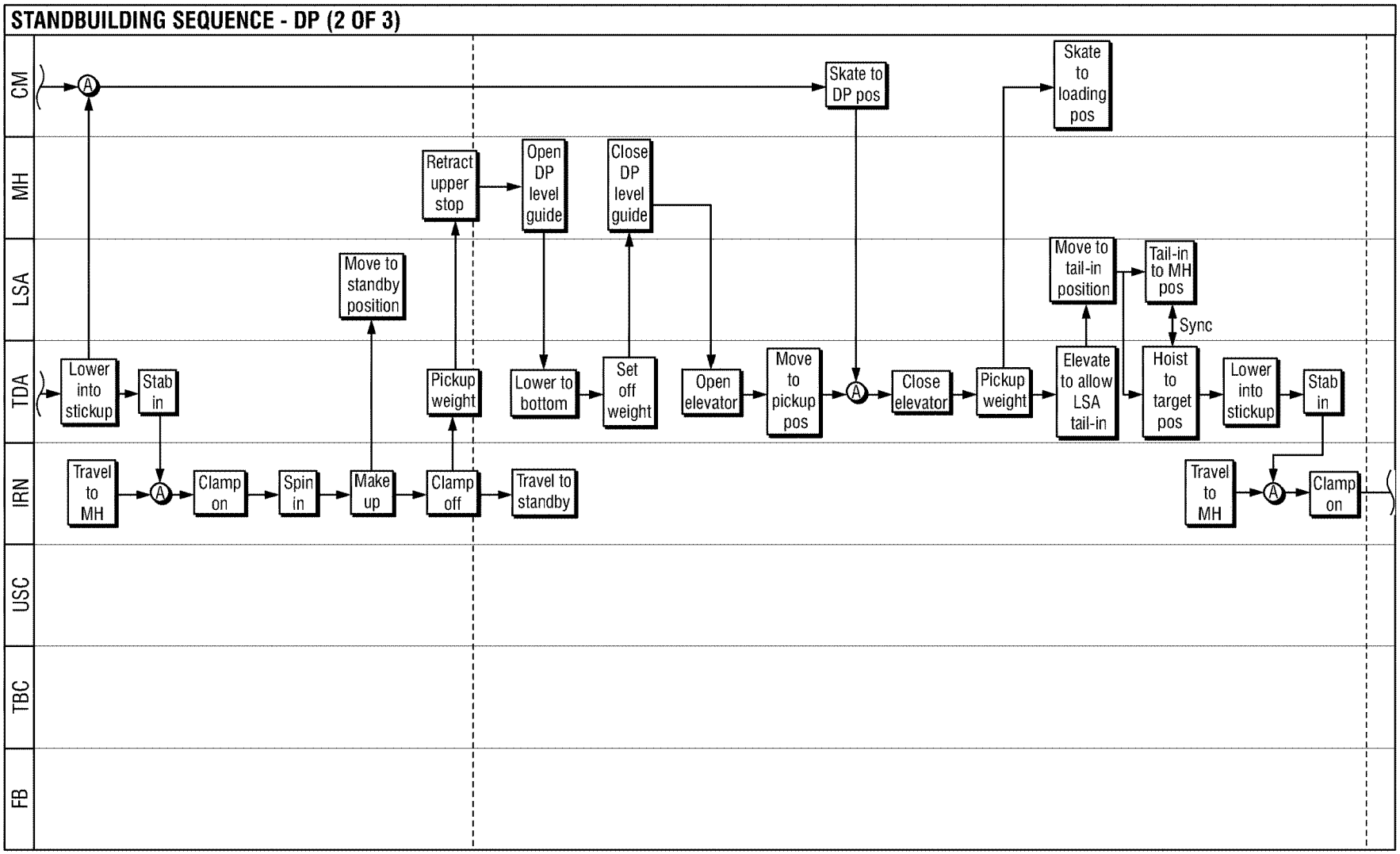
Figure 18C:
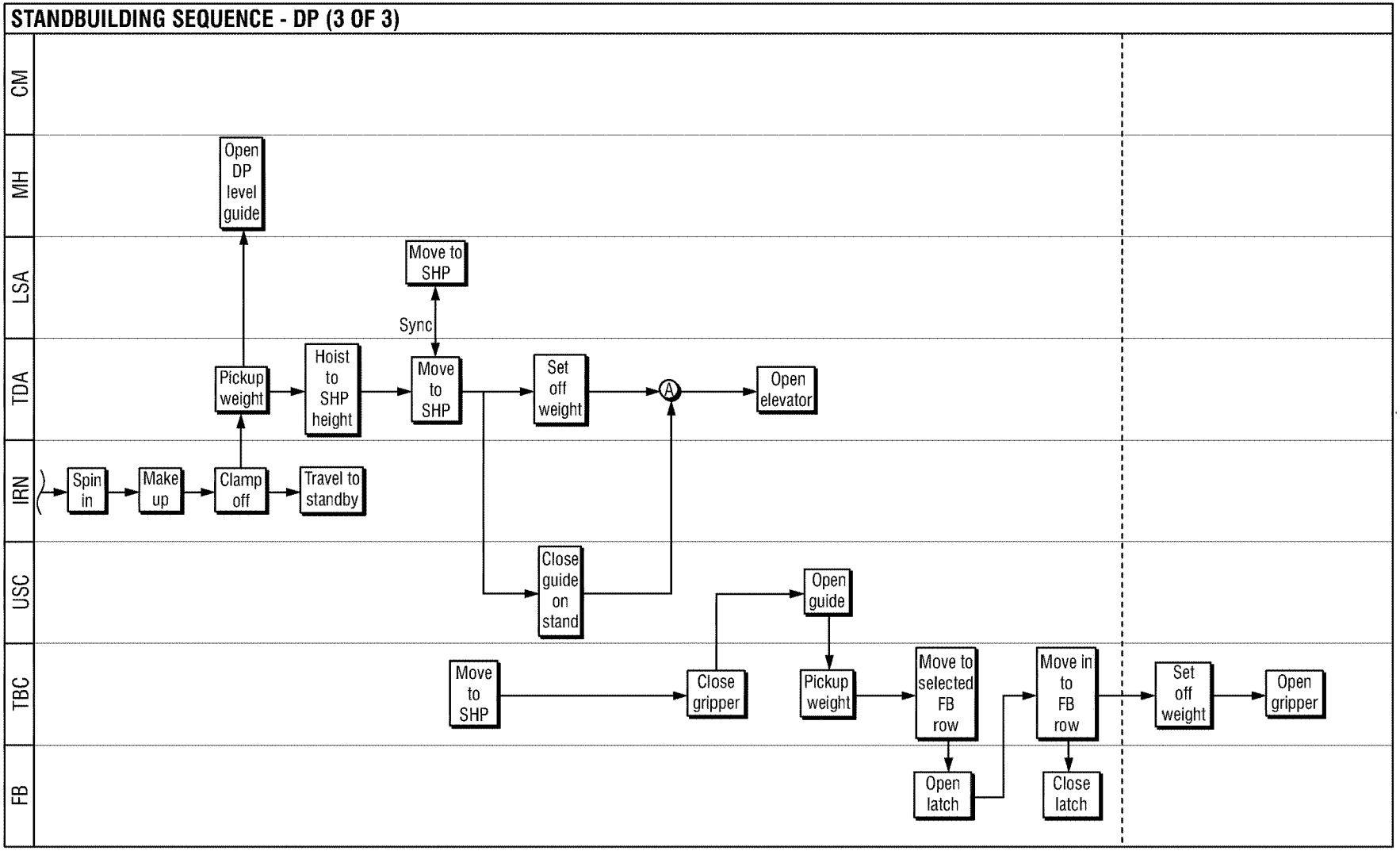

FIGS. 18A-18C shows a drillpipe standbuilding process flow diagram. As a 1st drill pipe is loaded onto a catwalk machine CM, an upper stop of a mouse hole MH is extended, a lower stabilizing arm LSA is moved to a standby position, and the TDA is moved to a pickup position. The skate of the CM moves the 1st drill pipe to offload position OP so that the TDA may close its elevator around box end of the 1st drill pipe. The TDA picks up the weight of the 1st drill pipe. As the TDA elevates the 1st drill pipe to allow the LSA to tail-in, the LSA moves to the tail-in position. The CW skate returns to the loading position and a 2nd drill pipe is loaded on the CW, while the LSA positions the tail of the 2nd drill pipe in the MH and the TDA elevates to the target position. The LSA then moves to its standby position. The TDA then lowers to the MH upper stop. The TDA then sets off the weight of the 1st drill pipe, the MH then closes its OF level guide, and the TDA opens its elevator. Having released the 1st drill pipe in the mouse hole, the TDA then moves to the pickup position to receive the 2nd drill pipe. The CW skate moves the 2nd drill pipe to the pickup position and the TDA closes its elevator around the 2nd drill pipe. The TDA picks up the weight of the 2nd drill pipe and the CW skate returns to its loading position. The TDA elevates the 2nd drill pipe to allow the LSA to move the 2nd drill pipe to the tail-in position. A 3rd drillpipe is loaded onto the CW. The LSA tails the 2nd drill pipe into the 1st drillpipe as the TDA is elevated to the target position. While the TDA is then lowered into the stickup, the pipe tong IRN travels to the MH. The TDA stabs the 2nd drill pipe into the 1st drillpipe. The IRN clamps on to the 1st drillpipe, spins the 2nd drill pipe into the 1st drillpipe, and makes-up the connection between the pipes. During make-up, the LSA moves to its standby position. The IRN clamps off the drill pipes and the TDA picks up the weight of the drill pipes as the MH retracts the upper stop. The MH opens the DF level guide and the TDA lowers the drill pipes to the bottom of the MH. The IRN returns to its standby position. The MH closes the DF level guide around the 2nd drill pipe and the TDA sets off the weight of the drill pipes in the MH. The TDA opens its elevator and moves to the pickup position to receive the 3rd drill pipe. The CW skate delivers the 3rd drill pipe to the TDA and the TDA closes its elevator around the pipe and picks up its weight. The CW skate returns to its loading position. The TDA elevates to lift the 3rd drill pipe and the LSA moves the hanging end of the pipe to a tail-in position. The TDA lowers the 3rd drill pipe into a stickup and the IRN travels to the MH. The pin end of the 3rd drill pipe stabs into the box end of the 2nd drill pipe as the TDA is lowered. The IRN clamps onto the 2nd drill pipe, spins the 3rd drill pipe, and makes-up the connection. The TDA picks-up the weight of the 3-pipe stand and the MH opens the level guide as the IRN clamps off the pipes. The IRN returns to its standby position and the TDA hoists the 3-pipe stand to the height of the SHP. The LSA, TDA and TBC all move to the SHP. The USC closes its guide on the stand and the TDA sets off the weight of the stand at the SHP. The TBC closes its gripper on the stand and the TDA opens its elevator to release the stand. The USC opens its guide as the TBC picks-up the weight of the stand. The TBC moves the stand to a selected FB row as the FB opens a latch in the row. The TBC moves the stand into the selection FB row and the FB closes the latch behind the stand. The TBC sets off the weight of the stand on the setback and opens its gripper to release the stand.

Figure 19A:
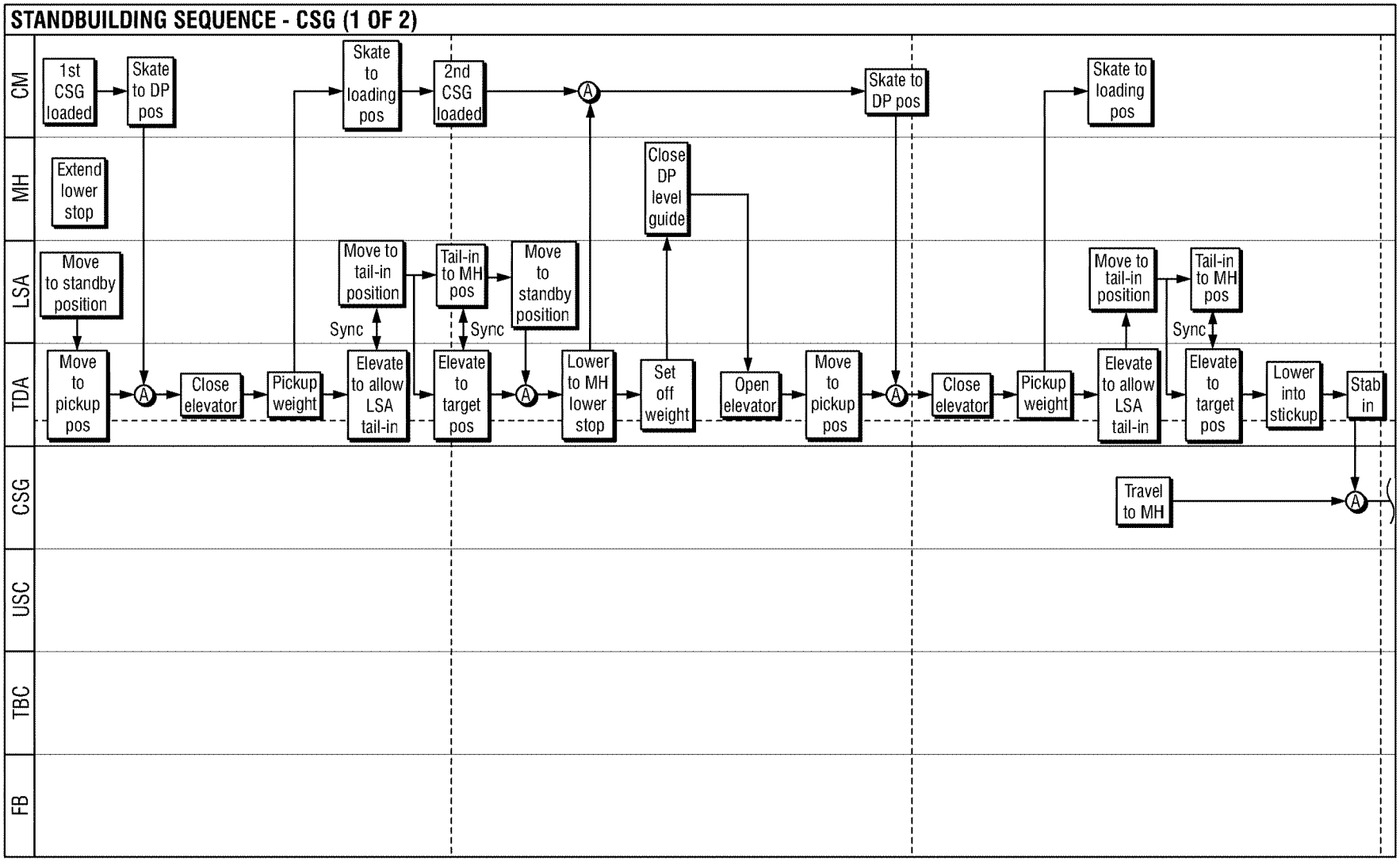
FIGS. 19A-19B show a flow diagram for a casing standbuilding process.
Figure 19B:
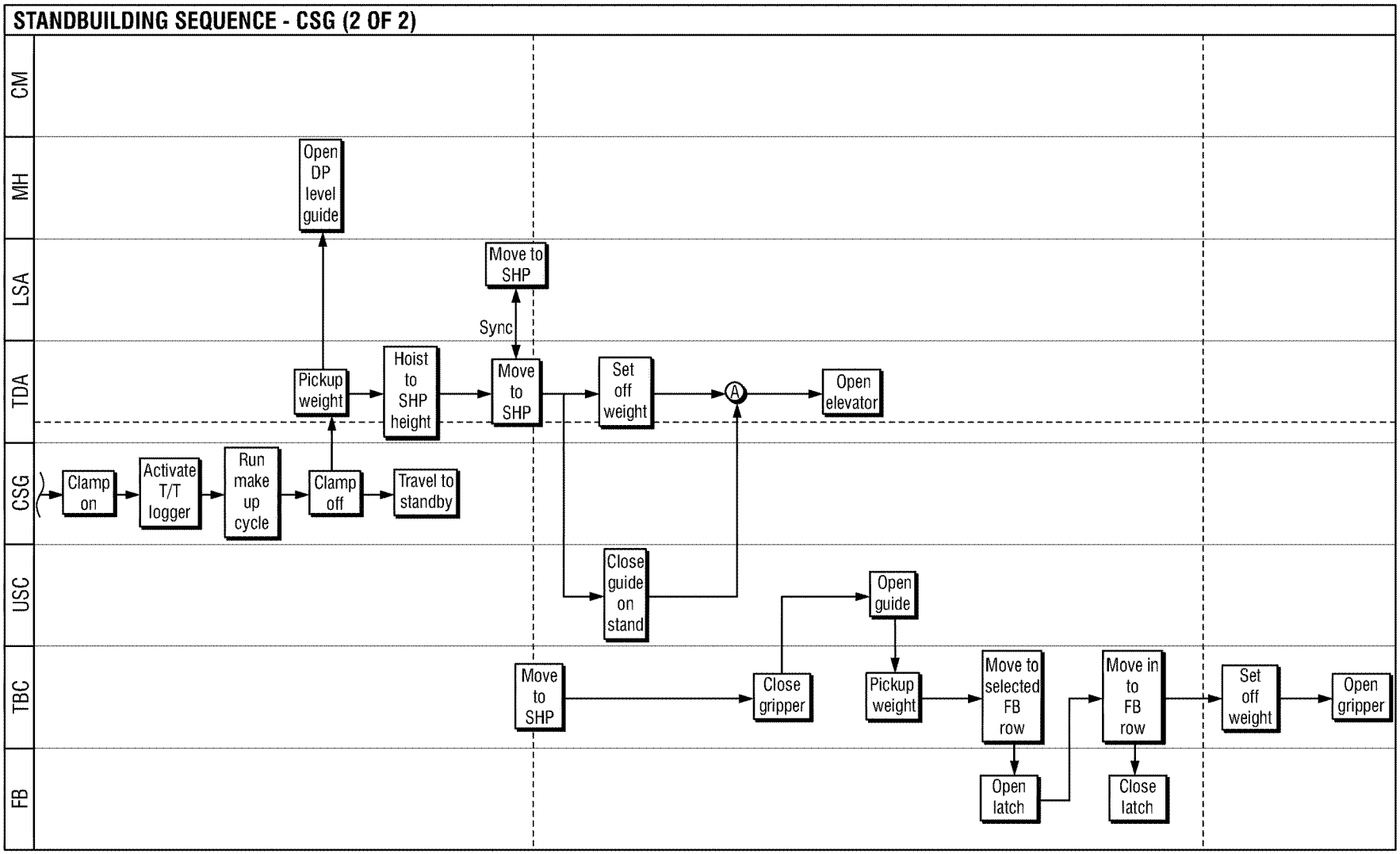

FIGS. 19A-19B illustrate a casing pipe standbuilding process flow diagram. This process is similar to the drill pipe standbuilding process flow described above with reference to FIGS. 19A-18C.

If used herein, the term "substantially" is intended for construction as meaning "more so than not."

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

Although the disclosed embodiments are described in detail in the present disclosure, it should be understood that various changes, substitutions and alterations can be made to the embodiments without departing from their spirit and scope.

INDUSTRIAL APPLICABILITY

Work stations for drilling rigs of the of the present invention have many industrial applications including but not limited to drilling vertical well bores and long lateral sections in horizontal wells for the oil and gas industry.

What is claimed is:

1. A workstation system for monitoring and controlling subsystems on a drilling rig, the system comprising:

a first workstation alcove positioned near a drill rig floor so as to provide an operator with direct lines of sight while sitting or standing in the alcove to at least one first drill rig subsystem being controlled by the first workstation, the first workstation alcove comprising:

an operator chair;

a plurality of controls for controlling the at least one first drill rig subsystem;

at least one display of a graphical representation of the at least one first drill rig subsystem; and a second workstation alcove positioned near the drill rig floor so as to provide an operator with direct lines of sight while sitting or standing in the alcove to at least one second drill rig subsystem being controlled by the second workstation, the second workstation alcove comprising:

an operator chair;

a plurality of controls for controlling the at least one second drill rig subsystem;

at least one display of a graphical representation of the at least one second drill rig subsystem, wherein the first workstation alcove is positioned in front of the second workstation alcove and the second workstation alcove is positioned higher than the first workstation alcove.

2. A workstation system as claimed in claim 1, wherein the at least one first subsystem is selected from a drawworks, a top drive, a mud system, a iron roughneck, a standbuilding system, a pipe handling system, a catwalk system, and a blow-out preventer.

3. A workstation system as claimed in claim 1, wherein the at least one second subsystem is selected from a drawworks, a top drive, a mud system, a iron roughneck, a standbuilding system, a pipe handling system, a catwalk system, and a blow-out preventer.

4. A workstation system as claimed in claim 1, wherein both the first and second workstation alcoves are positioned so as to provide operators with direct lines of sight while sitting or standing in the alcoves to a drawworks, a top drive, an iron roughneck, a standbuilding system, a pipe handling system, and a catwalk system.

5. A workstation system as claimed in claim 1, wherein both the first and second workstation alcoves are positioned so as to provide operators with direct lines of sight while sitting or standing in the alcoves to subsystems for performing a process of tripping.

6. A workstation system as claimed in claim 1, wherein both the first and second workstation alcoves are positioned so as to provide operators with direct lines of sight while sitting or standing in the alcoves to subsystems for performing a process of stand building.

7. A workstation system as claimed in claim 1, wherein the plurality of controls of both the first and second workstation alcoves are configurable to interchangeably control one or more subsystem selected from: a drawworks, a top drive, a mud system, a iron roughneck, a standbuilding system, a pipe handling system, a catwalk system, and a blow-out preventer.

8. A workstation system as claimed in claim 1, wherein control of drill rig subsystems is redundant such that control may be via the first workstation alcove, the second workstation alcove, or both.

9. A workstation system as claimed in claim 1, wherein the first and second workstation alcoves are within a single enclosure.

10. A workstation system as claimed in claim 1, further comprising a housing of the first and second workstation alcoves, wherein the housing is configured to be assembled to the drilling rig as a single module.

11. A process for monitoring and controlling subsystems on a drilling rig, the process comprising:

positioning a first workstation alcove near a drill rig floor so as to provide an operator with direct lines of sight while sitting or standing in the alcove to at least one first drill rig subsystem;

controlling the at least one first drill rig subsystem by the first workstation;

positioning a second workstation alcove near the drill rig floor so as to provide an operator with direct lines of sight while sitting or standing in the alcove to at least one second drill rig subsystem; and controlling the at least one second drill rig subsystem by the second workstation, wherein the first workstation alcove is positioned in front of the second workstation alcove and the second workstation alcove is positioned higher than the first workstation alcove.

12. A process for monitoring and controlling subsystems on a drilling rig as claimed in claim 11, wherein the at least one first subsystem is selected from a drawworks, a top drive, a mud system, a iron roughneck, a standbuilding system, a pipe handling system, a catwalk system, and a blow-out preventer.

13. A process for monitoring and controlling subsystems on a drilling rig as claimed in claim 11, wherein the at least one second subsystem is selected from a drawworks, a top drive, a mud system, a iron roughneck, a standbuilding system, a pipe handling system, a catwalk system, and a blow-out preventer.

14. A process for monitoring and controlling subsystems on a drilling rig as claimed in claim 11, wherein the positioning of both the first and second workstation alcoves provides operators with direct lines of sight while sitting or standing in the alcoves to a drawworks, a top drive, an iron roughneck, a standbuilding system, a pipe handling system, and catwalk system.

15. A process for monitoring and controlling subsystems on a drilling rig as claimed in claim 11, wherein the positioning of both the first and second workstation alcoves provides operators with direct lines of sight while sitting or standing in the alcoves to subsystems for performing a process of tripping.

16. A process for monitoring and controlling subsystems on a drilling rig as claimed in claim 11, wherein the positioning of both the first and second workstation alcoves provides operators with direct lines of sight while sitting or standing in the alcoves to subsystems for performing a process of stand building.

17. A process for monitoring and controlling subsystems on a drilling rig as claimed in claim 11, further comprising configuring the plurality of controls of both the first and second workstation alcoves to interchangeably control one or more subsystem selected from: a drawworks, a top drive, a mud system, a iron roughneck, a standbuilding system, a pipe handling system, a catwalk system, and a blow-out preventer.

18. A process for monitoring and controlling subsystems on a drilling rig as claimed in claim 11, further comprising redundantly controlling drill rig subsystems so that control may be via the first workstation alcove, the second workstation alcove, or both.

19. A process for monitoring and controlling subsystems on a drilling rig as claimed in claim 11, further comprising enclosing the first and second workstation alcoves within a single enclosure.

20. A process for monitoring and controlling subsystems on a drilling rig as claimed in claim 11, further comprising housing the first and second workstation alcoves in a single module for assembly to the drilling rig.

* * * * *